US005709123A

United States Patent [19]

Enami

[11] Patent Number: 5,709,123

[45] Date of Patent: Jan. 20, 1998

[54] PRESS WORKING MACHINE WITH A VERTICALLY MOVABLE LOWER MOLD AND A HORIZONTALLY MOVABLE WORKPIECE CARRIER

[75] Inventor: Toshiaki Enami, Kyoto, Japan

[73] Assignee: Enami Seiki Mfg. Co., Ltd., Yao, Japan

[21] Appl. No.: 607,692

[22] Filed: Feb. 27, 1996

[30] Foreign Application Priority Data

Mar. 13, 1995 [JP] Japan ..... 7-052152

[51] Int. Cl.[6] ..... B21J 13/08

[52] U.S. Cl. ..... 72/405.1; 72/405.01; 72/421; 72/452.1

[58] Field of Search ..... 72/405.1, 405.01, 72/421, 422, 452.1

[56] References Cited

U.S. PATENT DOCUMENTS

| | | | |
|---|---|---|---|
| 3,364,723 | 1/1968 | Gartside | 72/405.1 |
| 5,148,697 | 9/1992 | Shiraishi et al. | 72/405.1 |
| 5,159,827 | 11/1992 | Shiraishi et al. | 72/405.1 |
| 5,307,666 | 5/1994 | Bianchi . | |
| 5,383,348 | 1/1995 | Michael et al. | 72/405.1 |

FOREIGN PATENT DOCUMENTS

| | | |
|---|---|---|
| 1-205835 | 8/1989 | Japan . |
| WO9204145 | 3/1992 | WIPO . |

*Primary Examiner*—David Jones
*Attorney, Agent, or Firm*—W. G. Fasse; W. F. Fasse

[57] ABSTRACT

A press working machine includes a lower mold that is vertically movable between a first position for exchanging the lower mold, a second position for exchanging a workpiece, a third position for placing and displacing the workpiece on and from the lower mold, and a fourth position for pressing the workpiece between an upper mold and the lower mold. The machine further includes a servo motor and an eccentric cam for vertically moving the lower mold. A workpiece feed bar is moved only in the horizontal direction, whereby the structure of a feed bar horizontal mover is extremely simplified and the overall press working machine is also simplified in structure.

9 Claims, 32 Drawing Sheets

(S1)

(BOTTOM DEAD CENTER STATE)

(WORK HOLDING/SAFETY CONFIRMATION STATE)

(PRESSING STATE)

(S5)

(S6)

(S6)

(S8)

(S9)

(S10)

(S10)

(S12)

(S13)

(S14)

PRESS WORKING MACHINE WITH A VERTICALLY MOVABLE LOWER MOLD AND A HORIZONTALLY MOVABLE WORKPIECE CARRIER

BACKGROUND OF THE INVENTION

1. Field of the Invention

The present invention relates to a press working machine, and more specifically, it relates to the structure of a press working machine which can efficiently carry out press working.

2. Description of the Background Art

Press working is a working method of providing plastic deformation to a partial or overall area of a workpiece made of a material such as a metal with a press working machine that mainly carries out reciprocating compression, for performing molding, joining, separation or straightening of the workpiece.

Among press working machines having various applications, a flywheeled press working machine has a mechanical mechanism. This flywheeled press working machine places a workpiece on a fixed lower mold and vertically moves an upper mold through a large moment of inertia of the flywheel, thereby press-working the workpiece.

When the workpiece is introduced into and discharged from the aforementioned press working machine by a workpiece carrier, however, the upper mold which is downwardly moved in a stroke motion through the moment of inertia of the flywheel cannot be abruptly stopped upon misregistration of the workpiece. Further, horizontal and vertical movements are required for the workpiece carrier since the lower mold is in a fixed state. Therefore, the structure of the workpiece carrier is extremely complicated, leading to increase in cost for the press working machine and frequent failures of the workpiece carrier.

Due to the horizontal and vertical movements of the workpiece carrier, in addition, devices for confirming registration of the workpiece on the lower mold and retraction of the workpiece carrier in pressing of the workpiece are also extremely complicated when mechanical structures are employed. While the respective confirmation devices can be provided by electric structures with optical sensors or the like, such electric devices are inferior in reliability due to disturbances such as noises caused in the press working machine, a factory or the like.

SUMMARY OF THE INVENTION

An object of the present invention is to provide a press working machine which can extremely simplify the structures of various mechanisms, such as that for feeding a workpiece, by vertically moving a lower mold.

The press working machine according to the present invention comprises a lower mold base for fixing a lower mold, an eccentric cam having a pivot portion for pivotally supporting the lower mold base and a driving shaft portion serving as a rotation center. The press working machine further includes a servo motor which is connected with the driving shaft portion for rotating the eccentric cam to provide the lower mold with a first position for exchanging the lower mold, a second position for exchanging the workpiece, a third position for placing and displacing the workpiece on and from the lower mold, and a fourth position for pressing the workpiece with an upper mold and the lower mold. The present machine still further includes a workpiece carrier which is horizontally movable between a first state for placing and displacing the workpiece on and from the lower mold and a second state non-interfering with the upper and lower molds in pressing of the workpiece, a safety pin which is provided to upwardly extend along the direction of movement of the lower mold, a safety plate, which is provided on the workpiece carrier, having a hole capable of receiving the safety pin when the workpiece carrier is in the first state and the lower mold is at the third position, and a backup block, which is provided on the upper mold, having a hole for receiving the forward end portion of the safety pin upon insertion of the safety pin in the safety plate.

In the press working machine according to the present invention, the servo motor and the eccentric cam are employed to vertically move the lower mold between the first position for exchanging the lower mold, the second position for exchanging the workpiece, the third position for placing and displacing the workpiece on and from the lower mold, and the fourth position for pressing the workpiece with the upper and lower molds.

Thus, the workpiece carrier is only horizontally moved between the first state for placing and displacing the workpiece on and from the lower mold and the second state non-interfering with the upper and lower molds for pressing the workpiece. Thus, the workpiece carrier is not required to carry out a vertical movement, whereby its structure can be extremely simplified.

Further, the lower mold is vertically moved as hereinabove described, whereby registration of the workpiece and a safety state can be confirmed with an extremely simple structure by providing the upwardly extending safety pin on the lower mold while providing the safety plate and the backup plate having the holes for receiving the safety pin on the workpiece carrier and the upper mold respectively.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of a press working machine according to the present invention is now described with reference to FIGS. 1 and 2.

Figure 1:
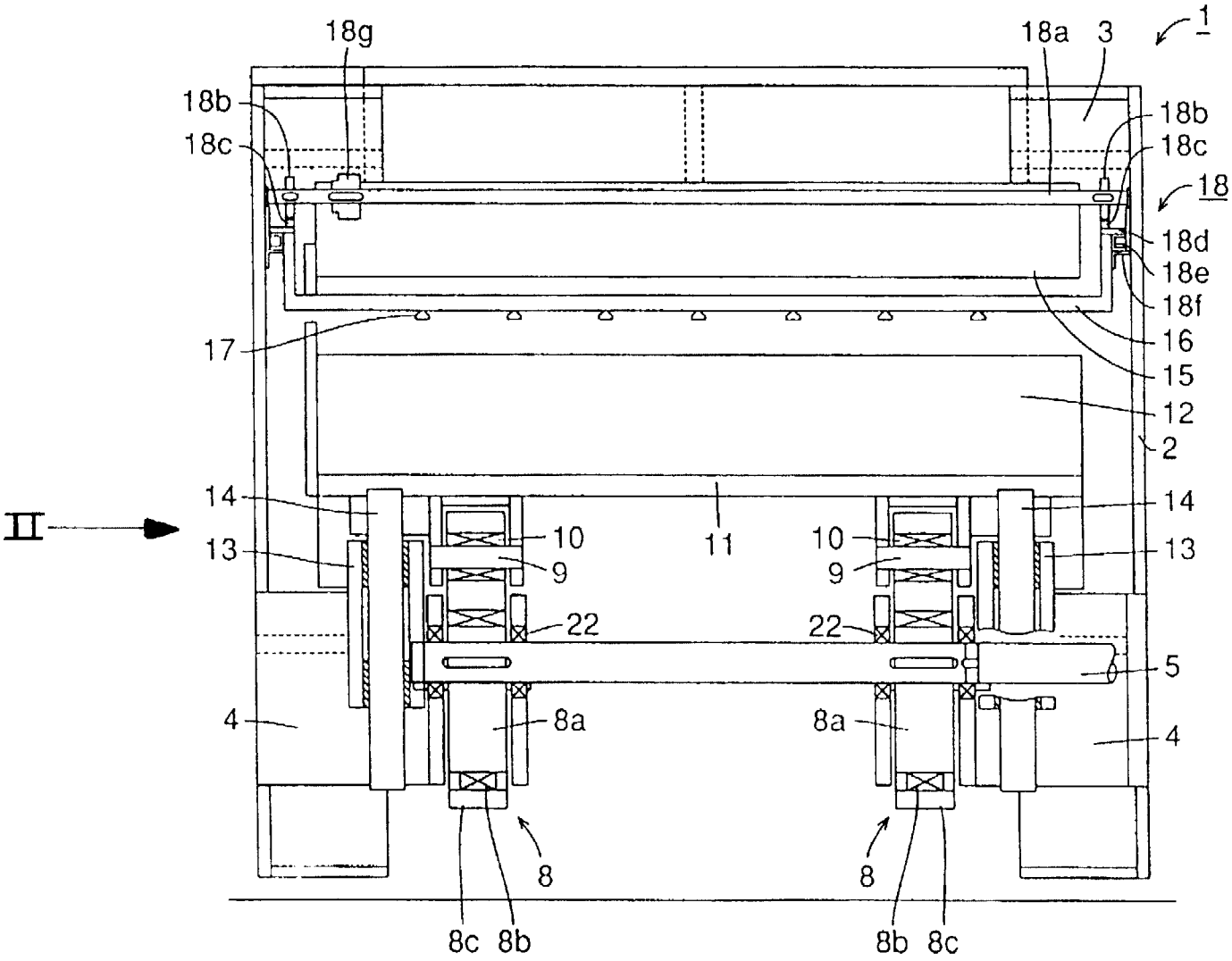
FIG. 1 is a front elevational view showing a press working machine according to an embodiment of the present invention.
Figure 2:
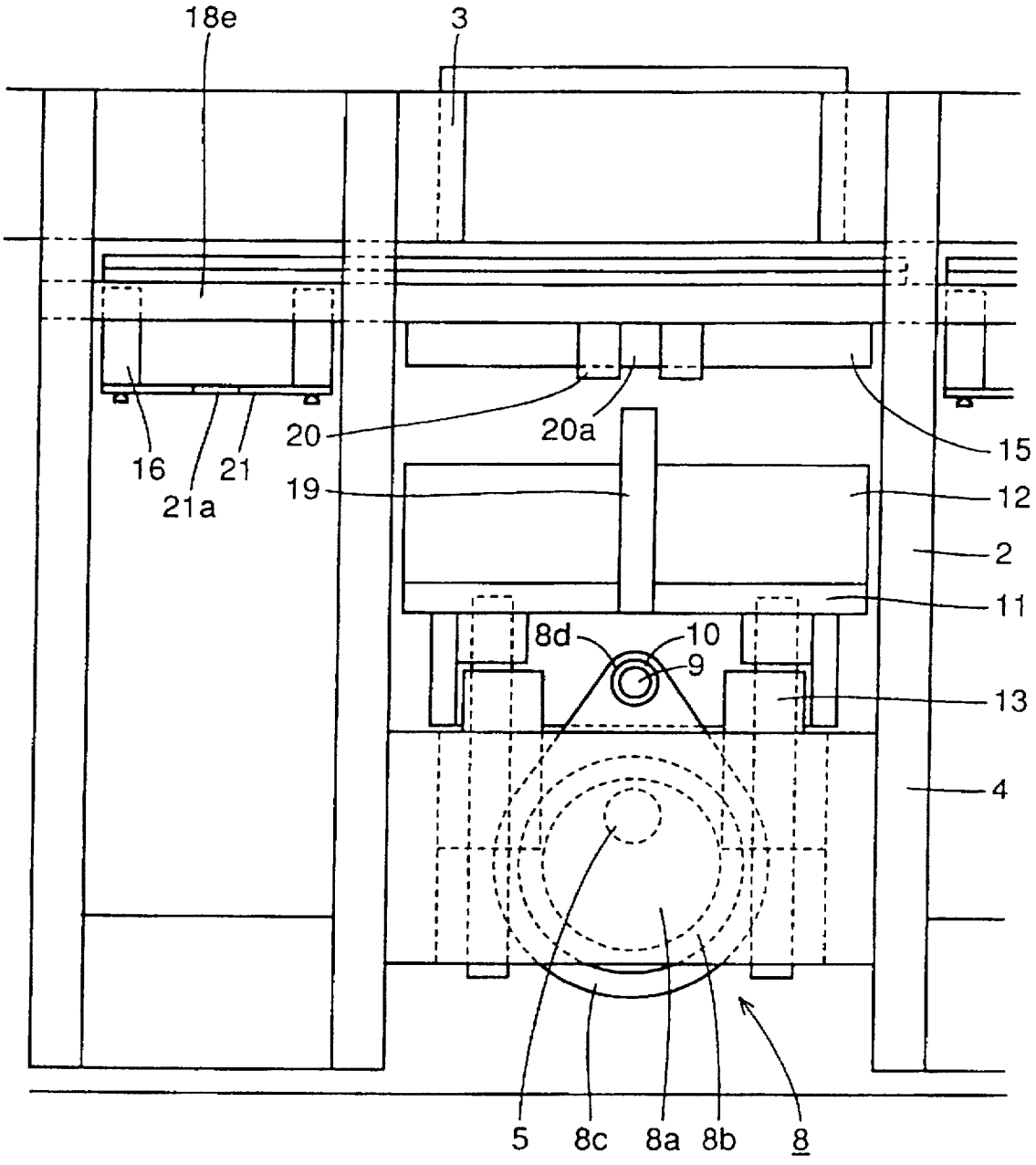
FIG. 2 is a side elevational view, for example in the direction of arrow II in FIG. 1, illustrating a bottom dead center state of the press working machine according to the embodiment of the present invention.

As shown in FIGS. 1 and 2, the frame body of this press working machine 1 is formed by vertical frames 2, transverse frames 3 and base frames 4. A driving shaft 5 is rotatably arranged on the base frames 4 through ball bearings 22. An ac servo motor (not shown) is connected to an end of the driving shaft 5.

Eccentric cams 8 are mounted on the driving shaft 5. Each eccentric cam 8 has a turntable 8*a* which is rotated with the driving shaft 5, and a cam plate 8*c* which is mounted through a ball bearing 8*b*.

A support shaft 9 passes through and is received in a ball bearing 10 arranged in a support hole 8*d* which is provided in an upper portion of the cam plate 8*c*. This support shaft 9 pivotally supports a lower mold base 11. This lower mold base 11 is adapted to fix a lower mold 12. Rods 14 which are provided on the lower mold base 11 are inserted in cylinders 13, to restrict the operational direction of motion of the lower mold base 11 to a vertical direction.

Above the lower mold 12, an upper mold 15 is fixed to a head frame 3 at a prescribed distance. A feed bar 16 for placing and displacing a workpiece on and from the lower mold 12 is provided between the lower mold 12 and the upper mold 15, and a plurality of absorption plates 17 are mounted on the feed bar 16 for supporting the workpiece. Further, a feed bar horizontal mover 18 is provided on the vertical frames 2, in order to horizontally move the feed bar 16.

This feed bar horizontal mover 18 has a rotary shaft 18*a* which is rotatably provided to bridge the right and left vertical frames 2 with each other, a gear 18*g* for transmitting the torque of a motor (not shown) to the rotary shaft 18*a*, pinions 18*b* for moving the feed bar 16, and racks 18*c*, which are engaged with the pinions 18*b*, provided on the feed bar 16. Further, the frames 2 are provided with guide rails 18*e* for horizontally slidably guiding the feed bar 16, which in turn is provided with guides 18*d* and 18*f* for supporting the guide rails 18*e* by vertically holding the same. Upon rotation of the rotary shaft 18*a*, therefore, the feed bar 16 can be horizontally moved along the guide rails 18*e*.

As shown in FIG. 2, the lower mold base 11 has a safety pin 19 which is provided to extend in the upward direction. On the other hand, the upper mold 15 has a safety block 20 comprising a location hole 20*a* which can receive the safety pin 19, while the feed bar 16 also has a safety plate 21 comprising a location hole 21 which can receive the safety pin 19.

The states of typical working positions of the lower mold 12 in the press working machine 1 having the aforementioned structure are now described with reference to FIGS. 2 to 5. The lower mold 12 of this press working machine 1 has a stroke of 200 mm and pressing ability of 35000 kg.

In the state shown in FIG. 2, the lower mold 12 is located at the lowermost position, whereby the lower mold 12 and the upper mold 15 can be exchanged in this state. For convenience of illustration, the state shown in FIG. 2 is hereinafter referred to as "bottom dead center state".

Figure 3:
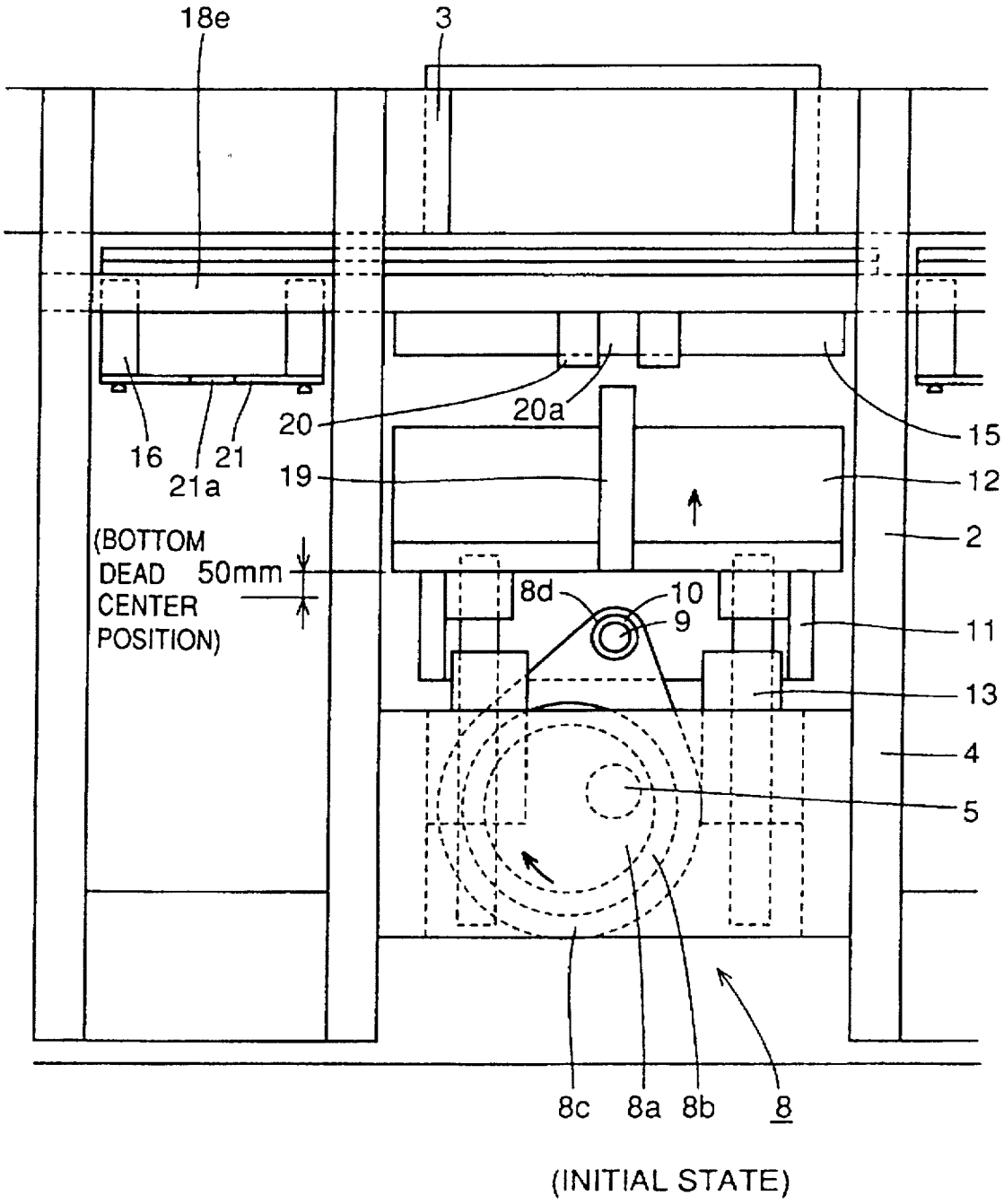
FIG. 3 illustrates an initial state of the press working machine according to the embodiment of the present invention.

In the state shown in FIG. 3, the rotary shaft 5 is rotated by about 70° from the "bottom dead center state", to upwardly move the lower mold 12 by 50 mm. In this state, the feed bar 16 is moved toward and retracted from the lower mold 12. For convenience of illustration, the state shown in FIG. 3 is hereinafter referred to as "initial state". Also when the rotary shaft 5 is rotated by about 290°, the lower mold 12 is at the same position as the above. Therefore, this state is also called "initial state".

Figure 4:
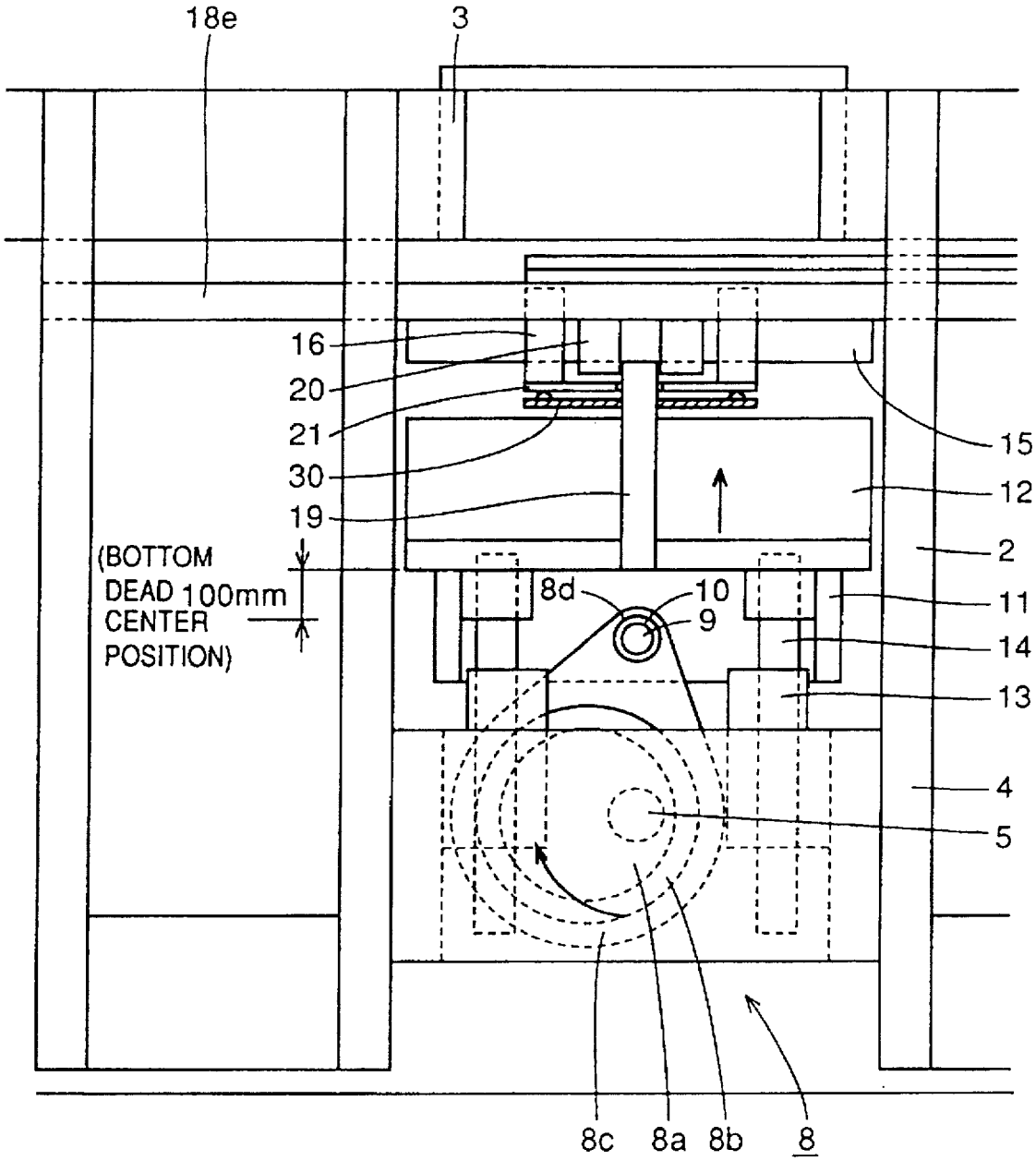
FIG. 4 illustrates a workpiece holding/safety confirmation state of the press working machine according to the embodiment of the present invention.

In the state shown in FIG. 4, the rotary shaft 5 is rotated by 90° from the "bottom dead center state" to upwardly move the lower mold 12 by a total of 100 mm. In this state, the feed bar 16 is positioned on the lower mold 12 for placing and displacing a workpiece 30 on and from the lower mold 12, and the safety pin 19 is inserted in the location holes 21*a* and 20*a* of the safety plate 21 and the backup block 20 respectively for confirming the position of the workpiece 30.

Thus, registration of the workpiece 30 on the lower mold 12 is confirmed. If the safety pin 19 comes into contact with the safety plate 21 at this time, this abnormal state is detected by a detector which is provided on the safety pin 19 or the safety plate 21 to immediately stop the ac servo motor while informing the machine operator of this state. At this time, due to the arrangement of the eccentric cam 8, the force for upwardly moving the lower mold 12 is extremely weak as compared with the pressing force that is applied for pressing the workpiece 30 since this force is merely adapted to bring the lower mold 12 into the state shown in FIG. 4 from the initial state, and hence the feed bar 16 and the safety plate 21 are not broken by this force.

Thus, the feed bar 16, the lower mold 12 and the upper mold 15 can be prevented from breaking through an extremely simple structure. For convenience of illustration, the state shown in FIG. 4 is hereinafter referred to as "workpiece holding/safety confirmation state". Also when the rotary shaft 5 is rotated by about 270°, the lower mold 12 is at the same position as the above. Therefore, this state is also called "work holding/safety confirmation state".

Figure 5:
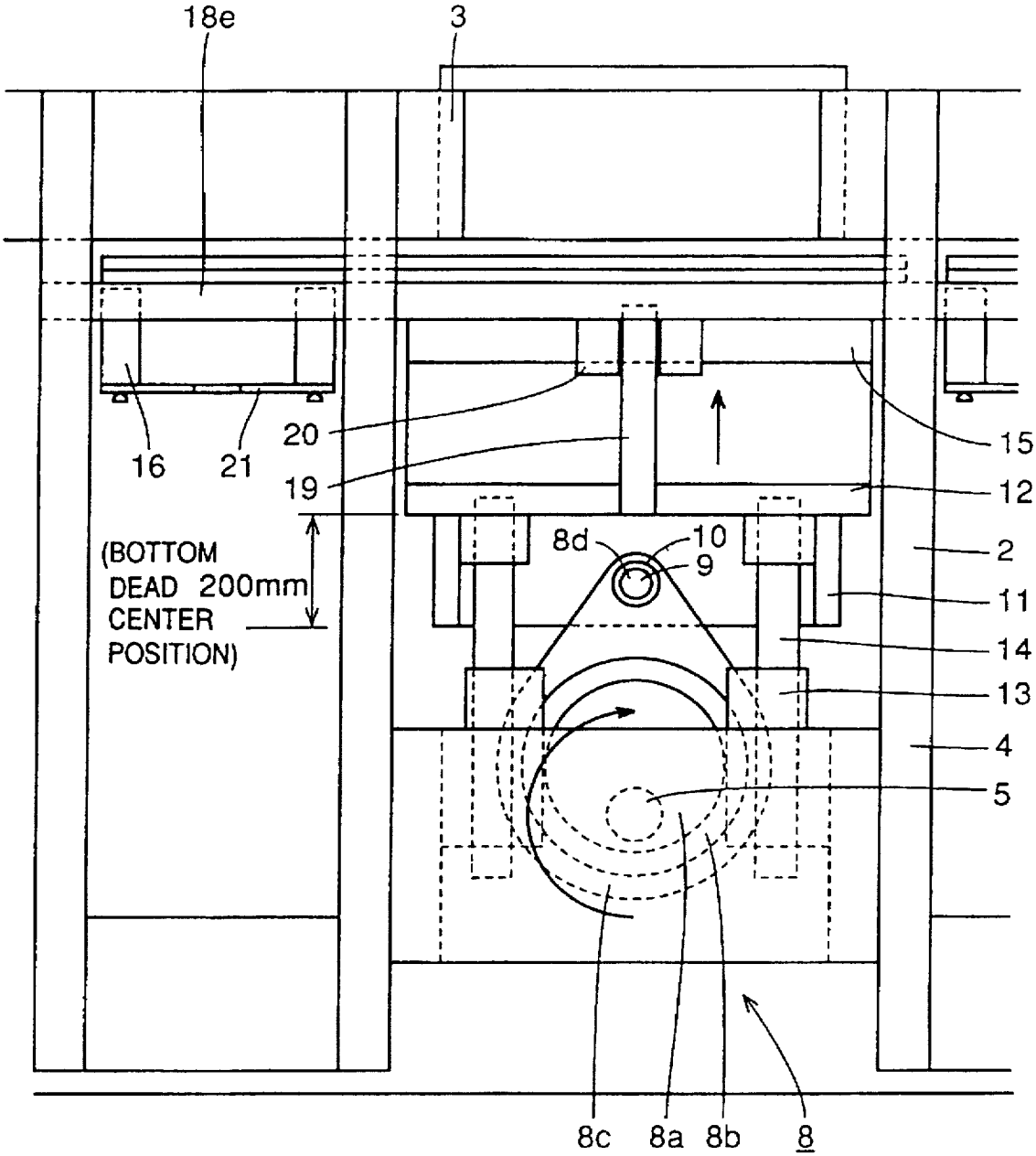
FIG. 5 illustrates a pressing state of the press working machine according to the embodiment of the present invention.

In the state shown in FIG. 5, the rotary shaft 5 is rotated by 180° from the "bottom dead center state", to upwardly move the lower mold 12 by 200 mm. In this state, the workpiece 30 is pressed with and between the lower mold 12 and the upper mold 15. For convenience of illustration, the state shown in FIG. 5 is hereinafter referred to as "pressing state".

Figure 6:
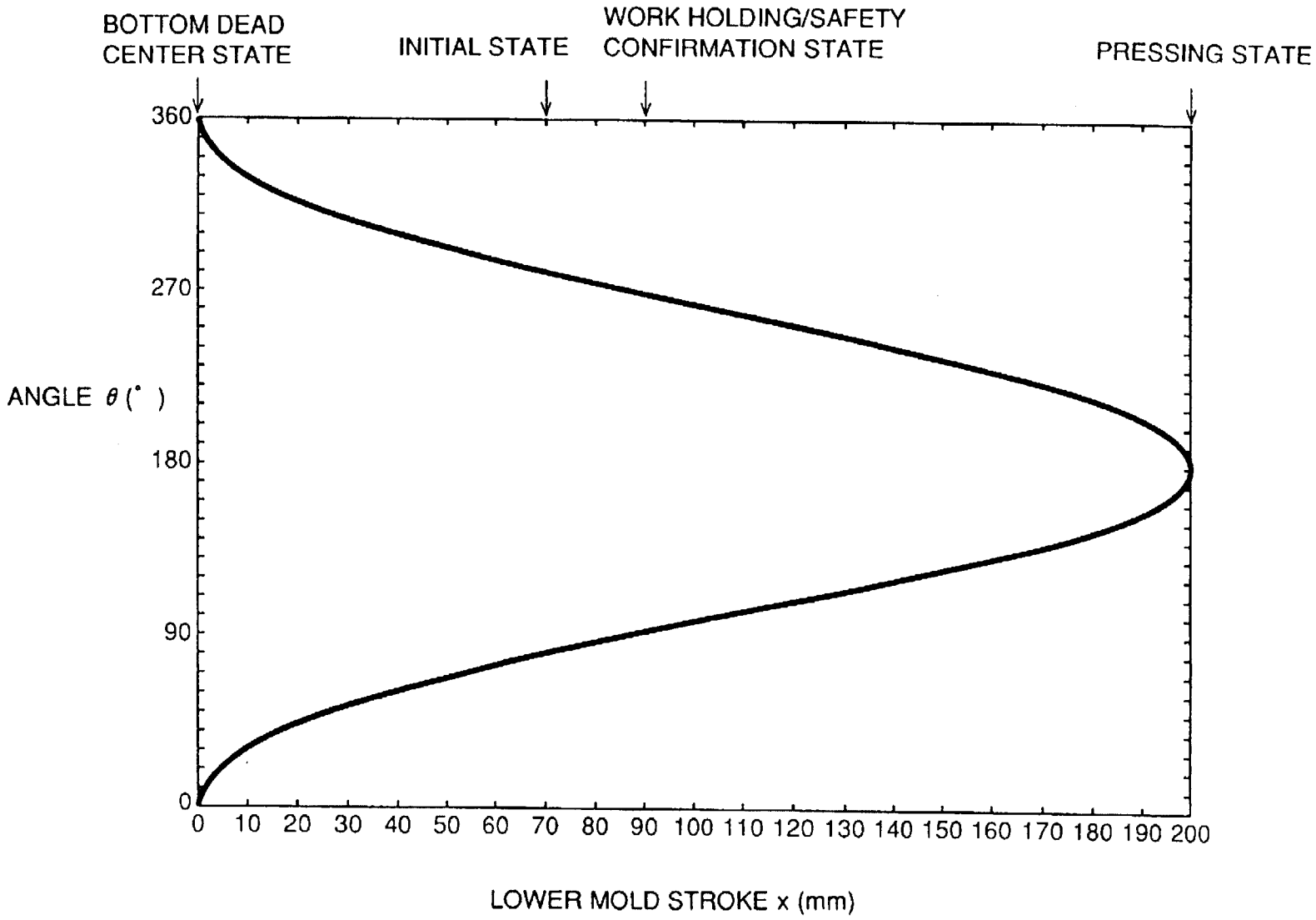
FIG. 6 illustrates the relation between the angle of rotation of a press rotary shaft and the stroke of a lower mold in the press working machine according to the embodiment of the present invention.
Figure 7:
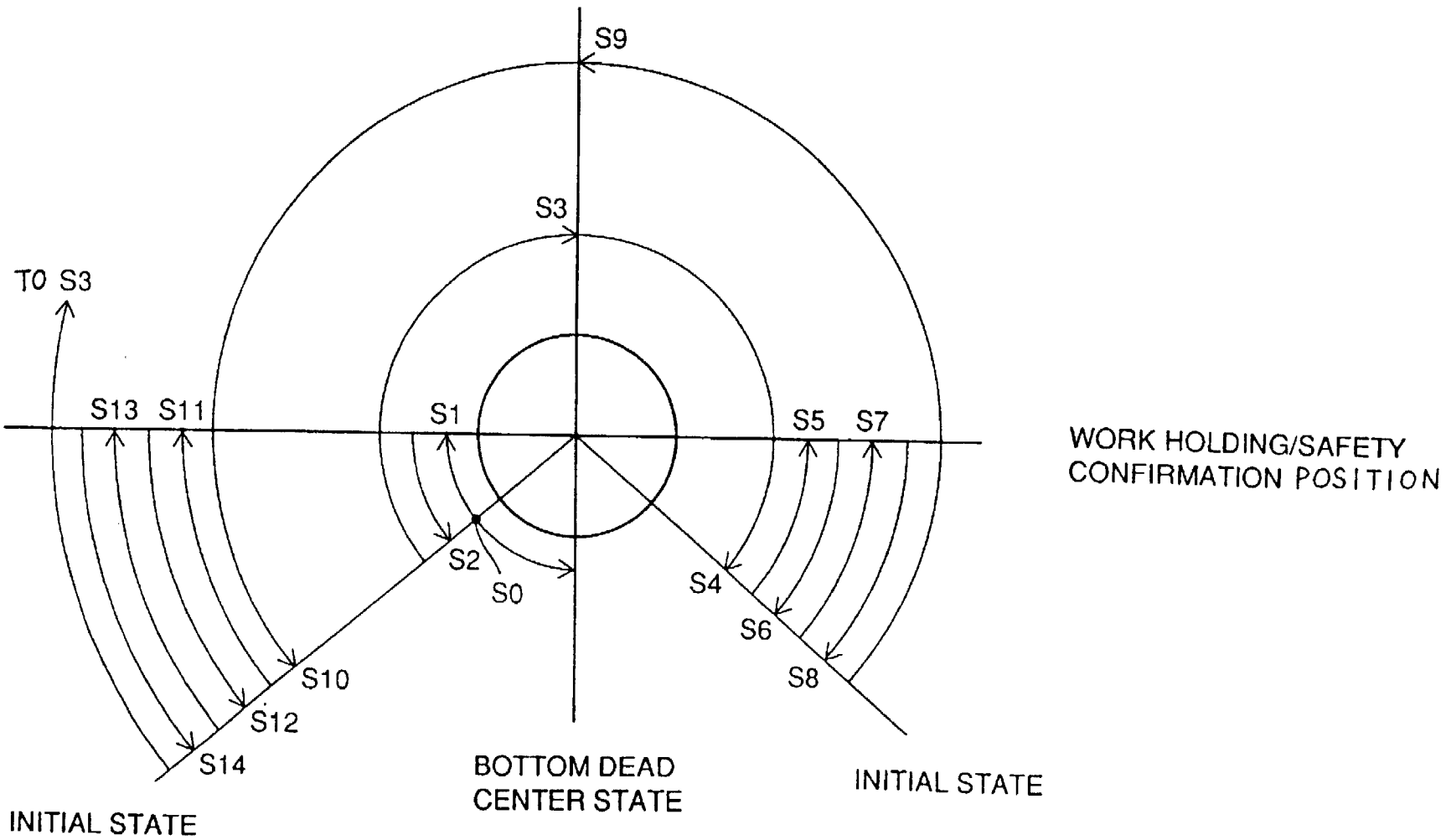
FIG. 7 is a graph showing positions of the lower mold in press working steps of the press working machine according to the embodiment of the present invention.

FIG. 6 illustrates the relation between the angle (θ) of rotation of the rotary shaft 5 and the stroke of the lower mold 12. The angle (θ) of rotation of the rotary shaft 5 is 0° or 360° in the "bottom dead center state" where the stroke of the lower mold 12 is zero, while the same is 70° or 290° in the "initial sate", 90° or 270° in the "workpiece holding/safety confirmation state", and 180° in the "pressing state" respectively.

With reference to FIGS. 7 to 32, four pressing steps for pressing the outer frame of a washing machine with four press working machines $P_1$ to $P_4$ will now be described.

The press working machines $P_1$, $P_2$, $P_3$ and $P_4$ are adapted to carry out cutting and perforation, Z-bending of four sides, hemming and 90°-bending, and R-bending and 90°-bending of both ends respectively.

Figure 8:
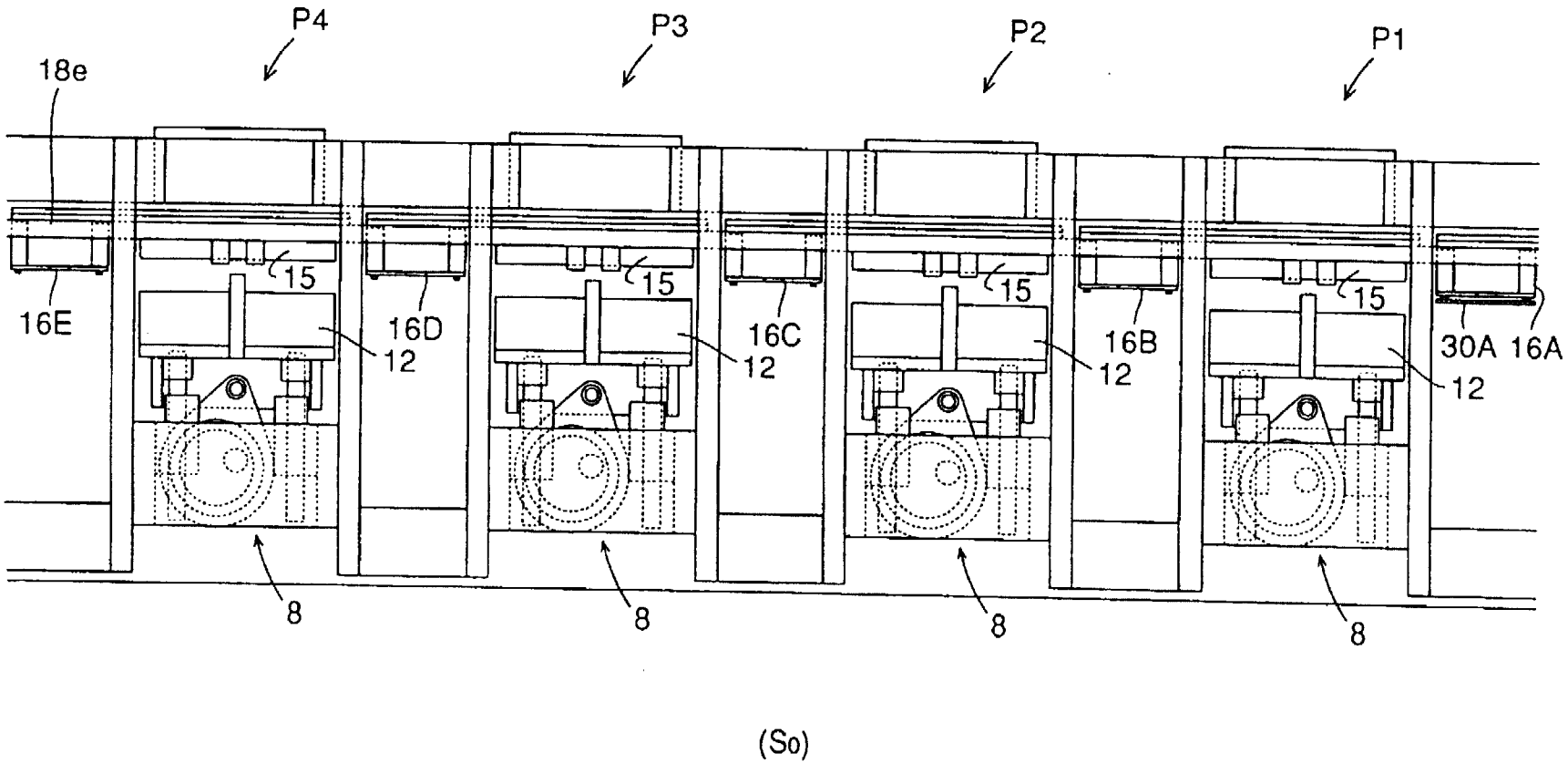
FIGS. 8 to 30 are first to 23rd step diagrams showing the press working steps of the press working machine according to the embodiment of the present invention.

In the state show in FIG. 8, the press working machines $P_1$ to $P_4$ are in the "initial states", and only a feed bar 16A holds a workpiece 30A, which is in a raw or unworked condition. This state corresponds to a state $S_0$ show in FIG. 7.

Figure 9:
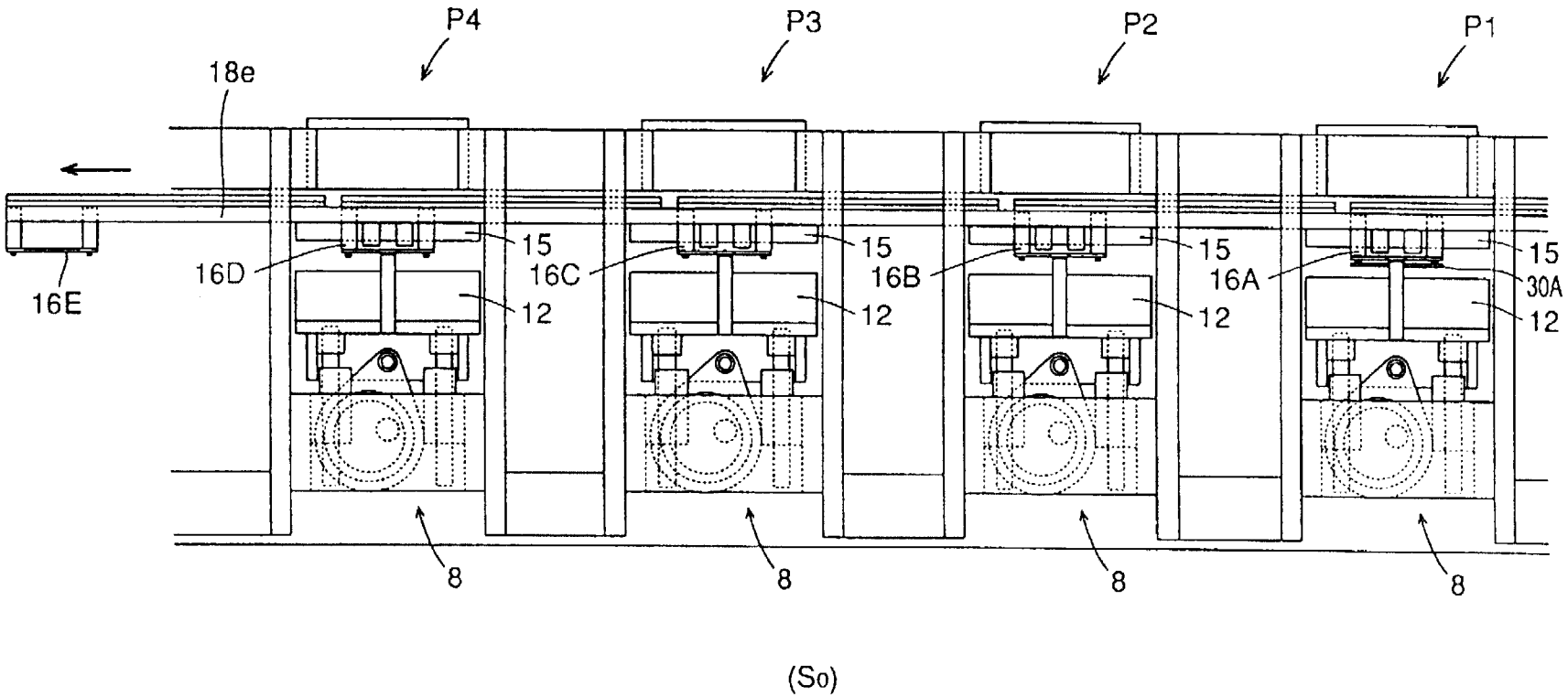

Referring to FIG. 9, feed bars 16A to 16E are leftwardly moved along guide rails 18*e*, to be located above lower molds 12. At this time, the press working machines $P_1$ to $P_4$ are in the "initial states".

Figure 10:
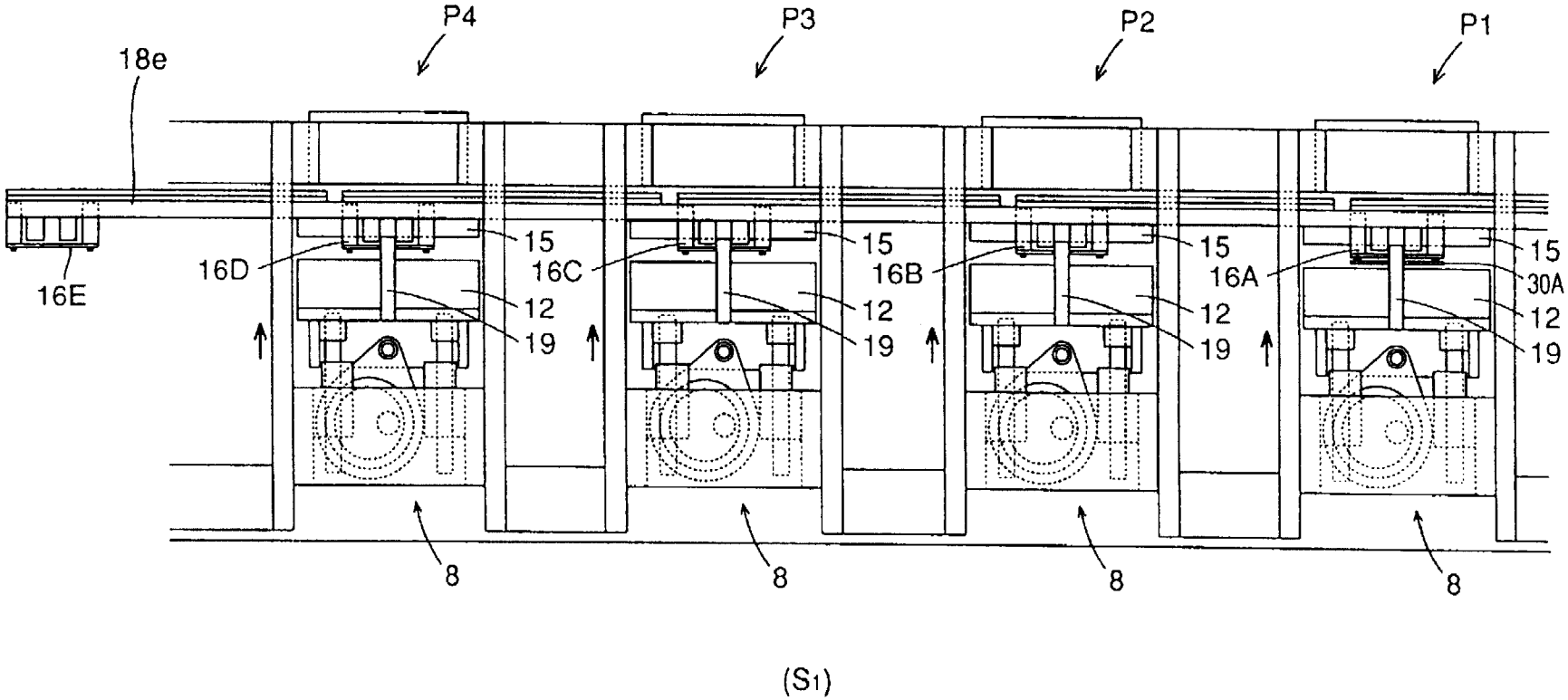

Referring to FIG. 10, the press working machines $P_1$ to $P_4$ are then brought into "workpiece holding/safety confirmation states" from the "initial states". At this time, the safety pin 19 of the press working machines $P_1$ confirms location of the workpiece 30A while the safety pin 19 of each of the press working machines $P_2$ to $P_4$ confirms alignment of the upper and lower molds. Thereafter the workpiece 30A is placed on the lower mold 12 of the press working machine $P_1$. At this time, each of the press working machines $P_1$ to $P_4$ are in a state $S_1$ shown in FIG. 7.

Figure 11:
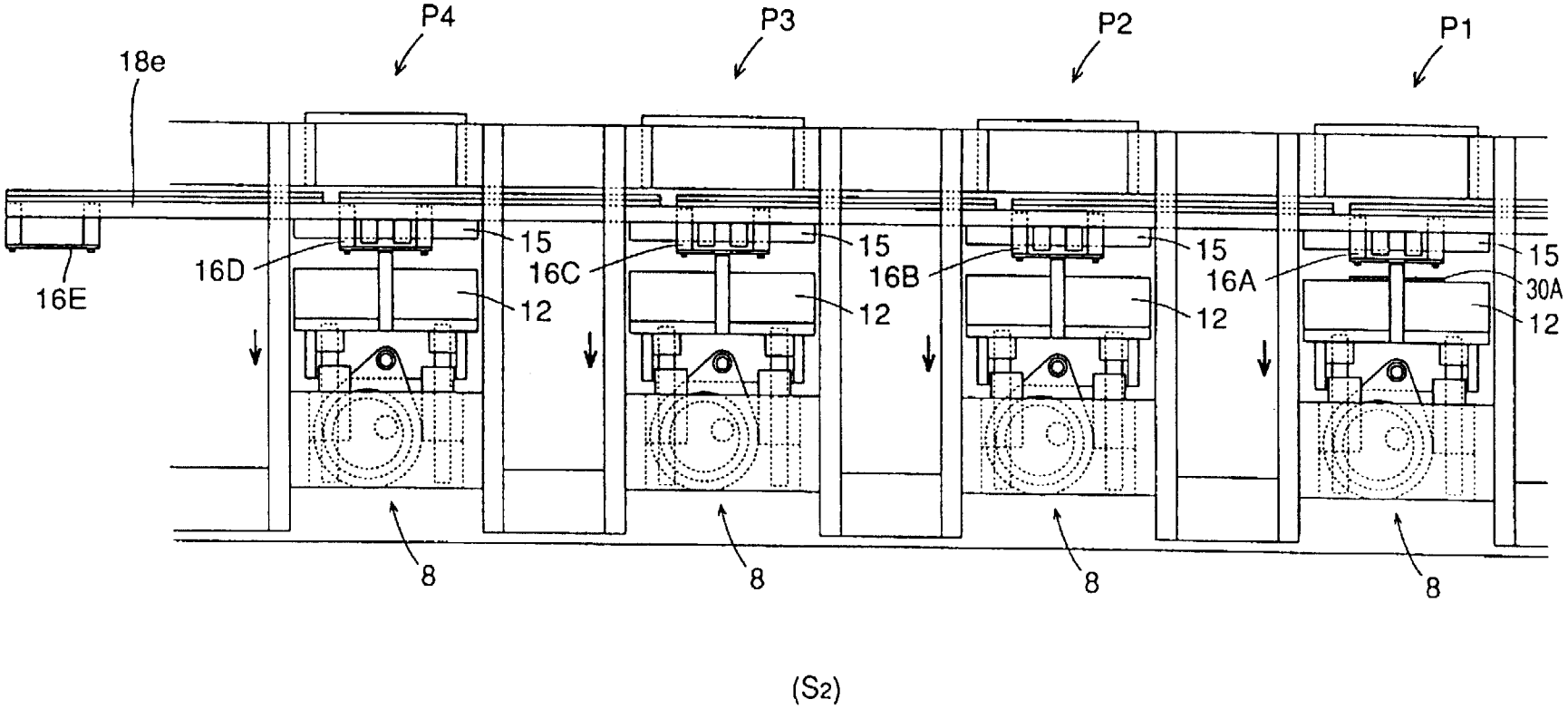
Figure 12:
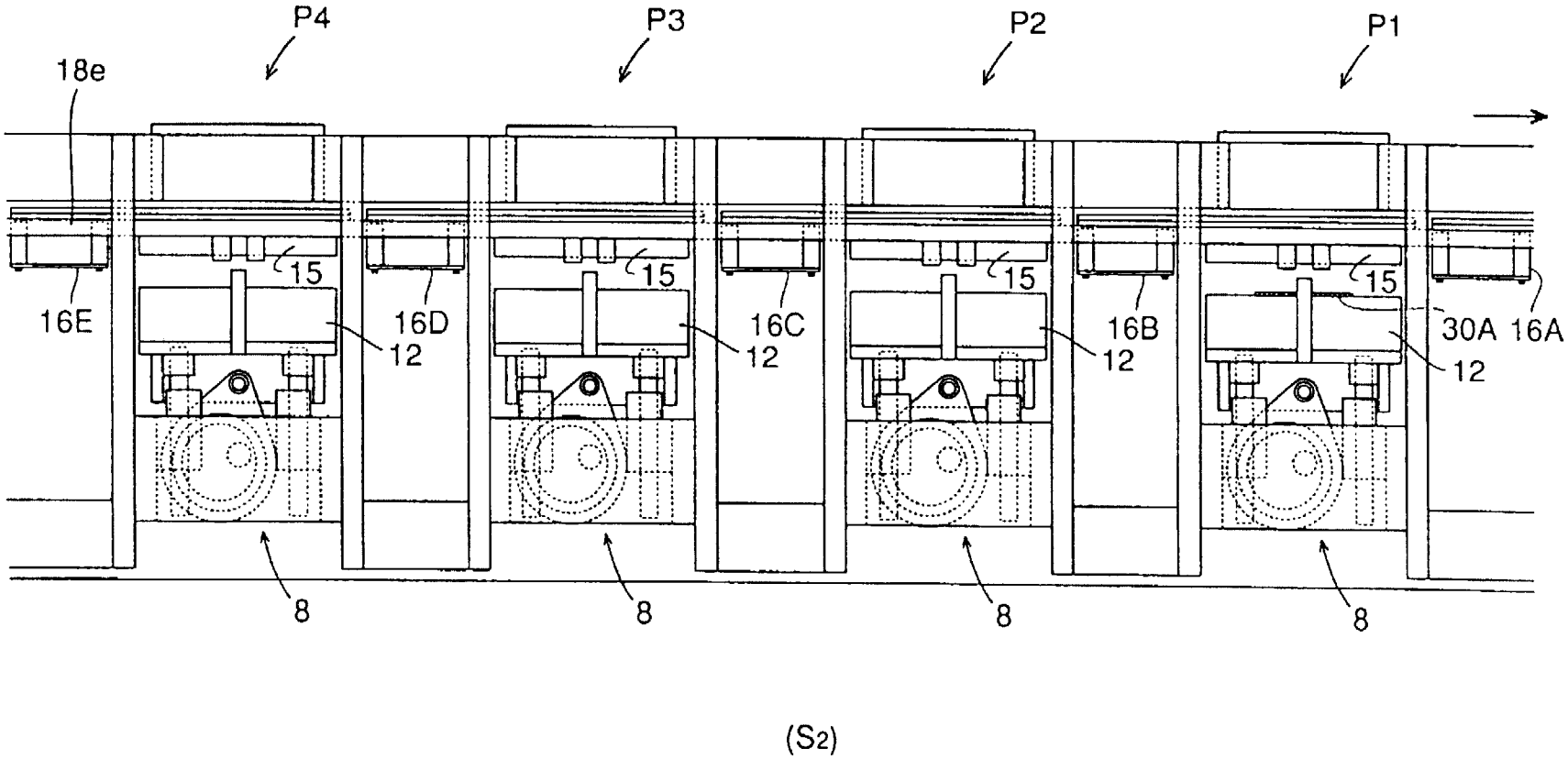

Referring to FIG. 11, the press working machines $P_1$ to $P_4$ are brought into "initial states" from the "workpiece holding/safety confirmation states". This state corresponds to a state $S_2$ shown in FIG. 7. Thereafter the feed bars 16A to 16E are rightwardly moved/retracted, as shown in FIG. 12.

Figure 13:
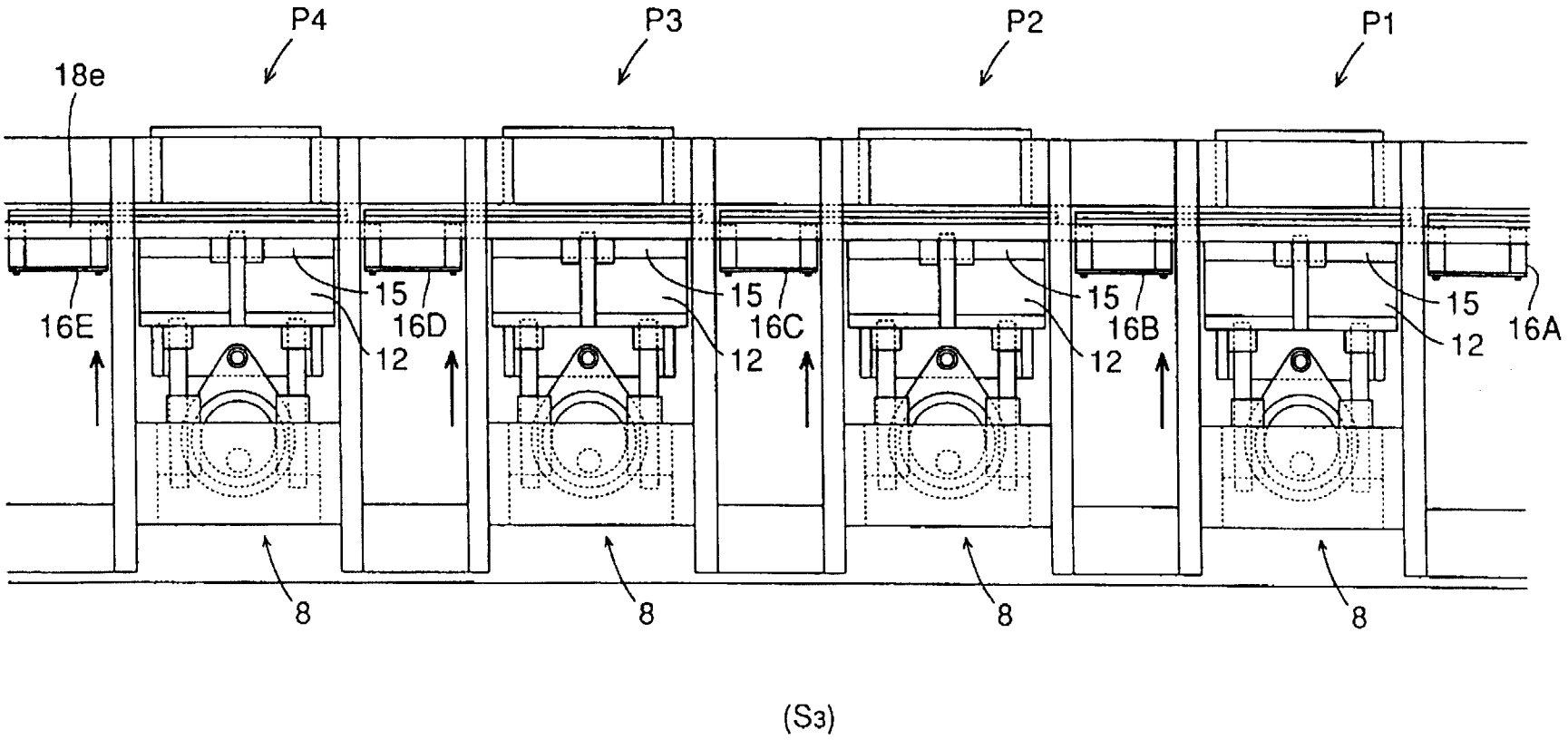
Figure 31:
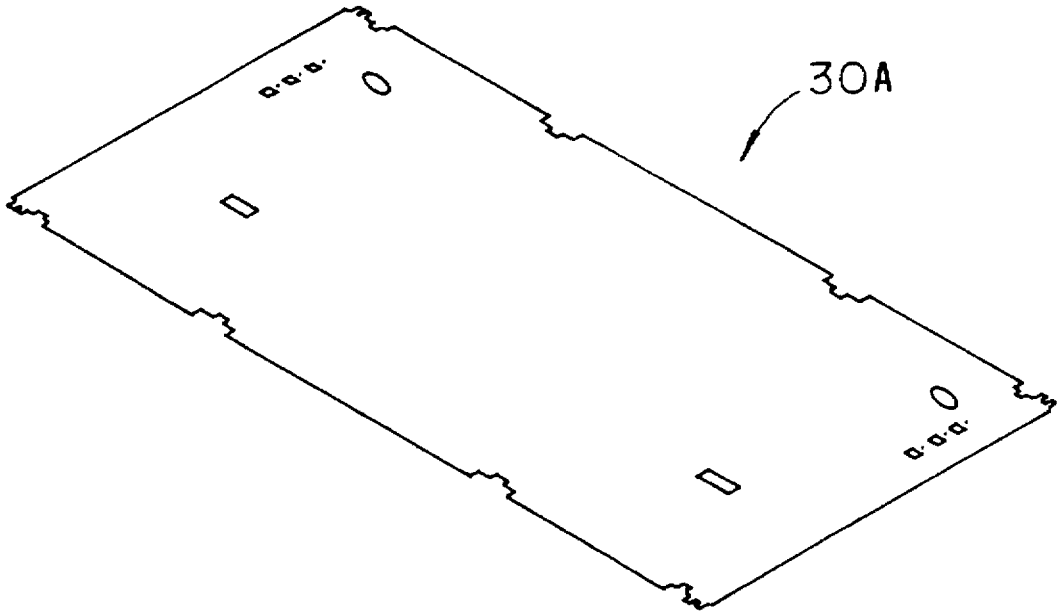
FIG. 31 illustrates the outer shape of a workpiece which is worked with a press working machine $P_1$.
Figure 32:
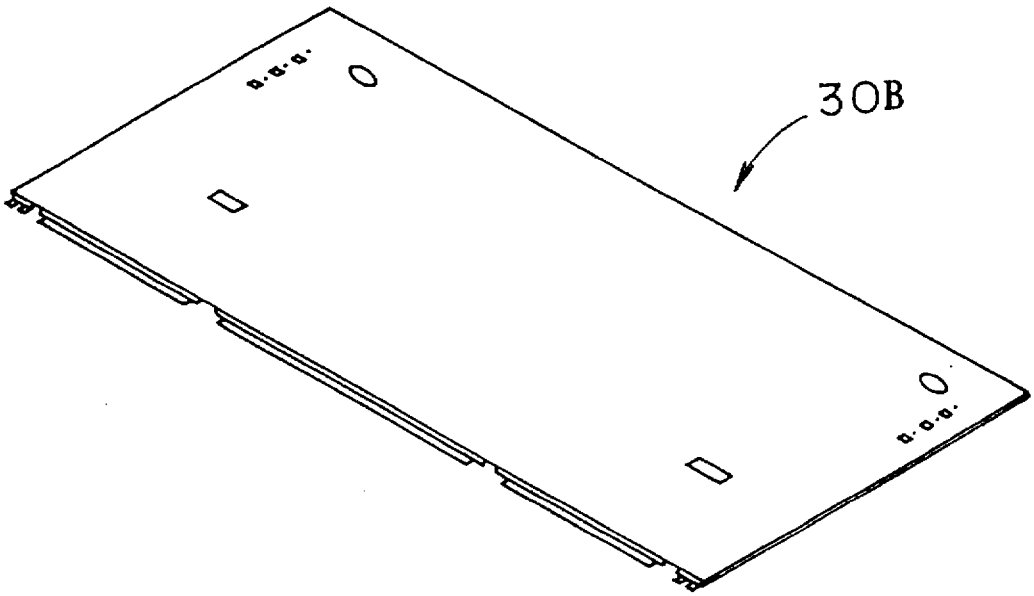
FIG. 32 illustrates the outer shape of a workpiece which is worked with a press working machine $P_2$.

Referring to FIG. 13, the press working machines $P_1$ to $P_4$ are brought into "pressing states" from the "initial states", to press the workpiece 30A with the lower mold 12 and the upper mold 15 of the press working machine $P_1$ for forming a semifinished workpiece 30B by cutting and perforating the raw workpiece 30A, as shown in FIG. 31. This state corresponds to a state $S_3$ shown in FIG. 7.

Figure 14:
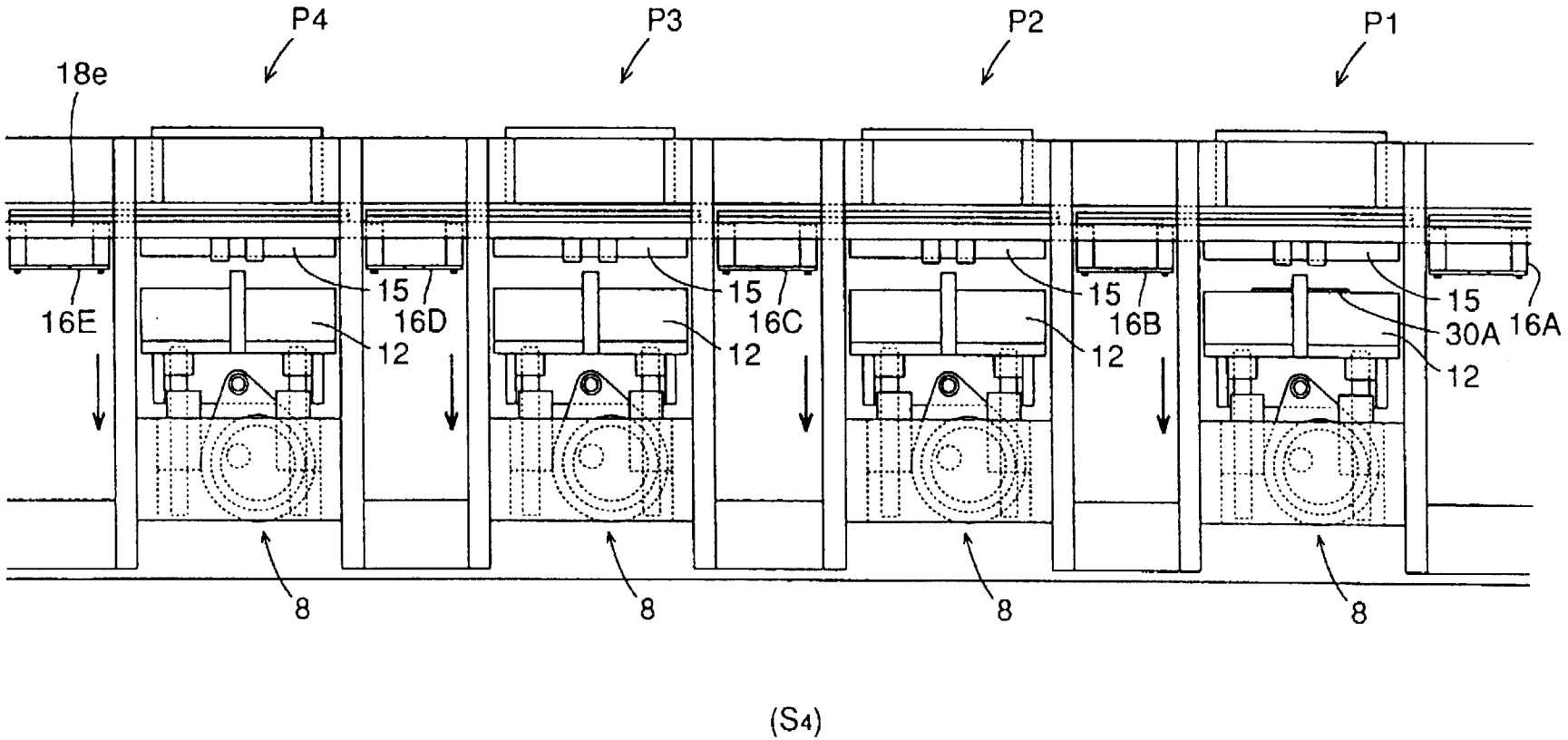
Figure 15:
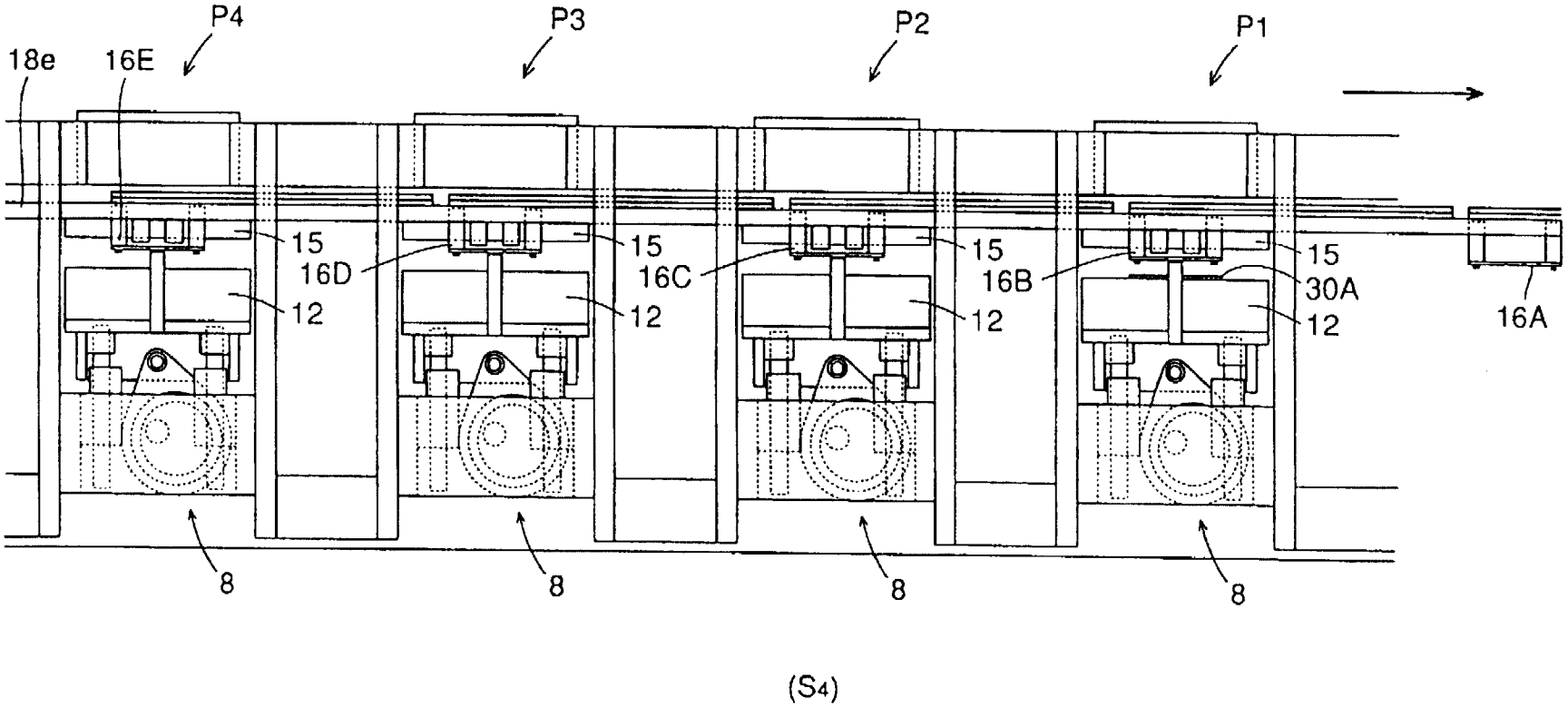

Referring to FIG. 14, the press working machines $P_1$ to $P_4$ are brought into "initial states" from the "pressing states". This state corresponds to a state $S_4$ shown in FIG. 7. The steps shown in FIGS. 13 and 14 are not stopped in the "pressing states", but carried out as a series of operations. Thereafter the feed bars 16A to 16E are rightwardly moved as shown in FIG. 15.

Figure 16:
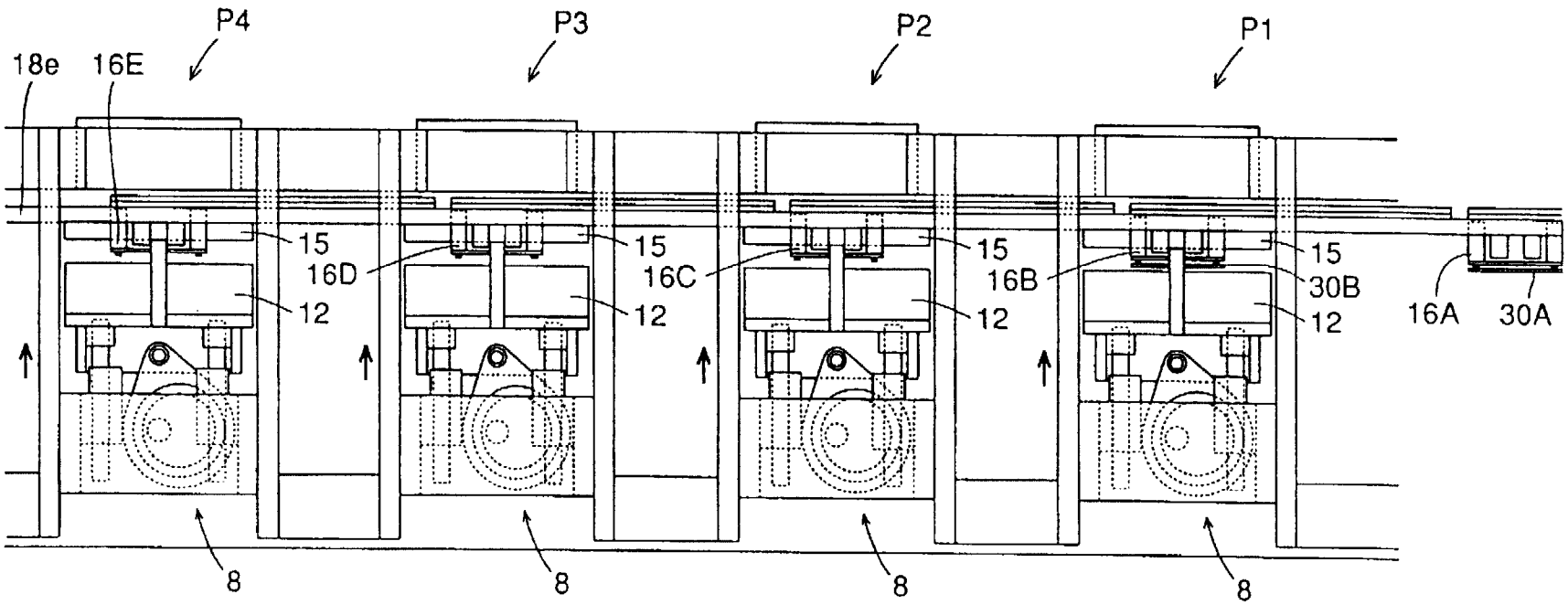

Referring to FIG. 16, the press working machines $P_1$ to $P_4$ are brought into "workpiece holding/safety confirmation states" from the "initial states". Thereafter the feed bar 16A holds a new raw workpiece 30A, while the feed bar 16B holds the semifinished workpiece 30B which has been worked by the press working machine $P_1$. This state corresponds to a state $S_5$ shown in FIG. 7.

Figure 17:
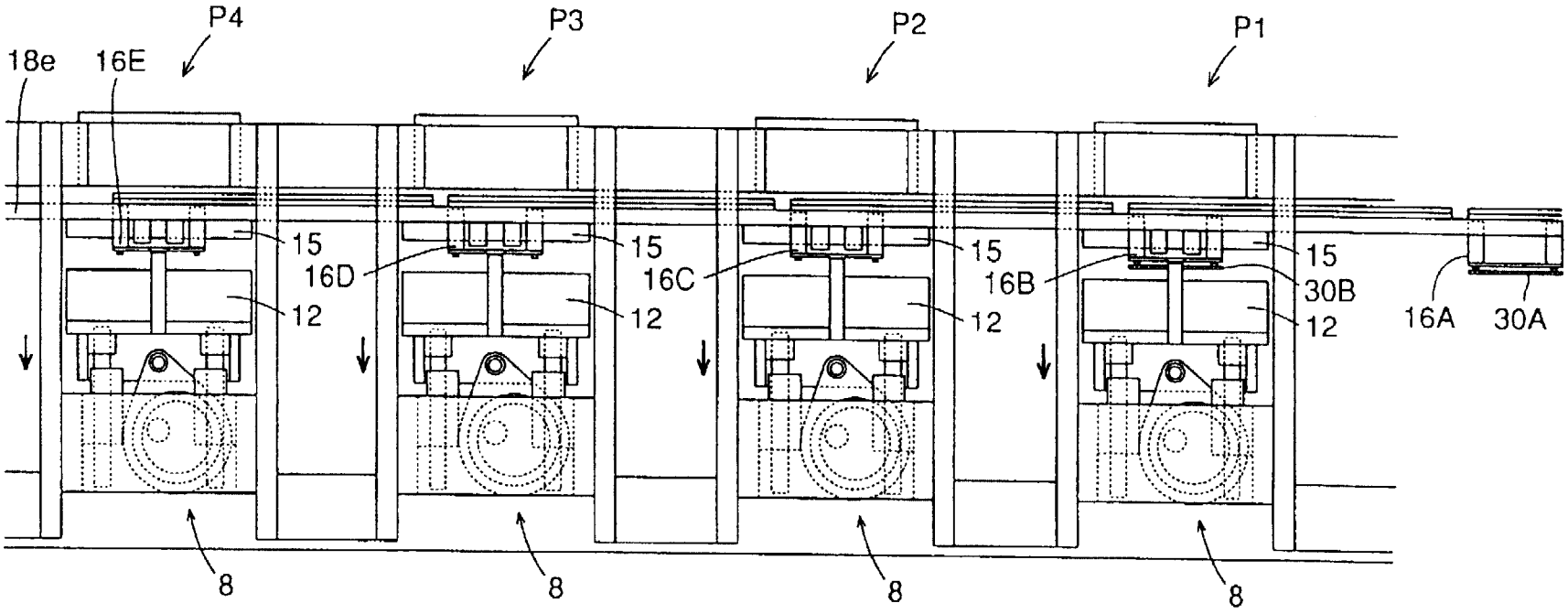

Referring to FIG. 17, the press working machines $P_1$ to $P_4$ are brought into "initial states" from the "workpiece holding/safety confirmation states". This state corresponds to a state $S_6$ shown in FIG. 7.

Figure 18:
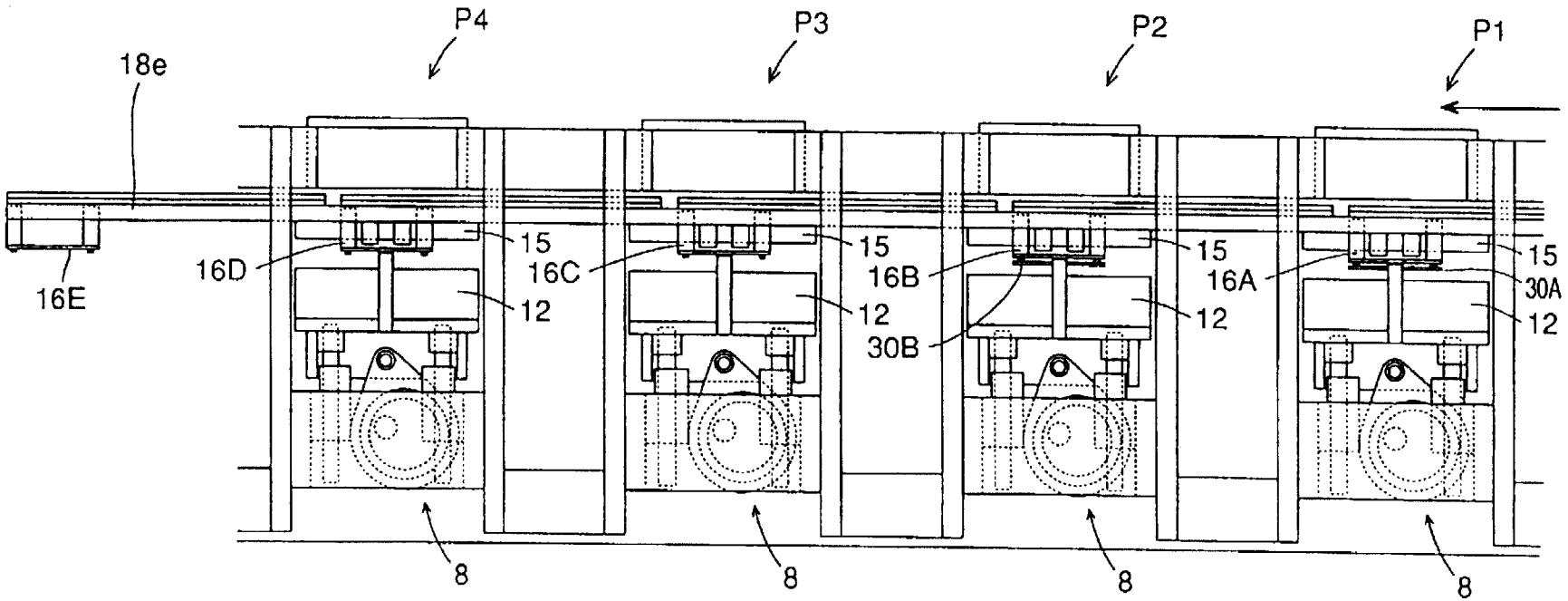
Figure 19:
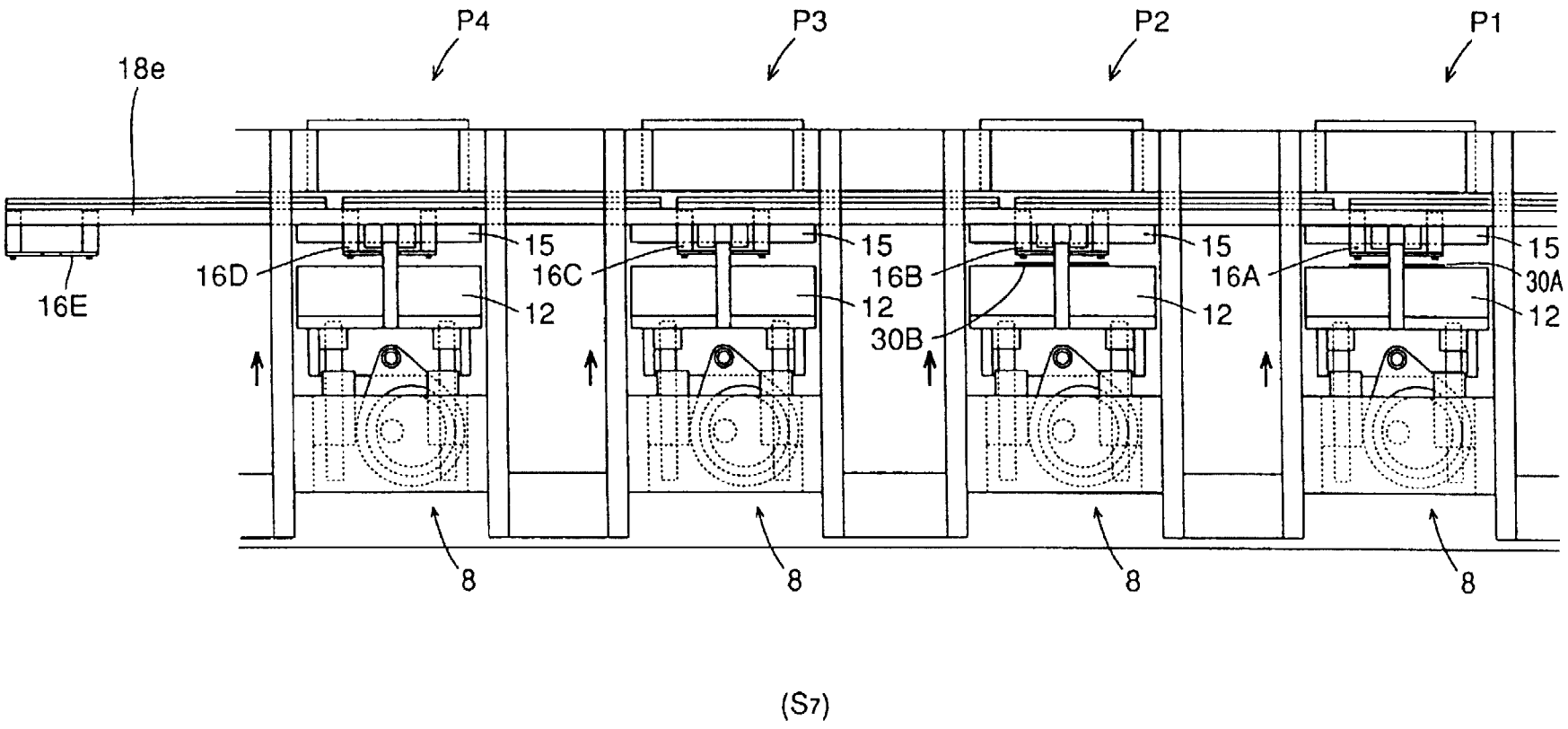

Referring to FIG. 18, the feed bars 16A to 16E are leftwardly moved. Thereafter, in FIG. 19, the press working machines $P_1$ to $P_4$ are brought into "workpiece holding/safety confirmation states" from the "initial states", for placing the workpieces 30A and 30B on the lower molds 12 of the press working machines $P_1$ and $P_2$ respectively. At this time, the safety pins 19 of these press working machines $P_1$ and $P_2$ confirm location of the workpieces 30A and 30B. This state corresponds to a state $S_7$ shown in FIG. 7.

Figure 20:
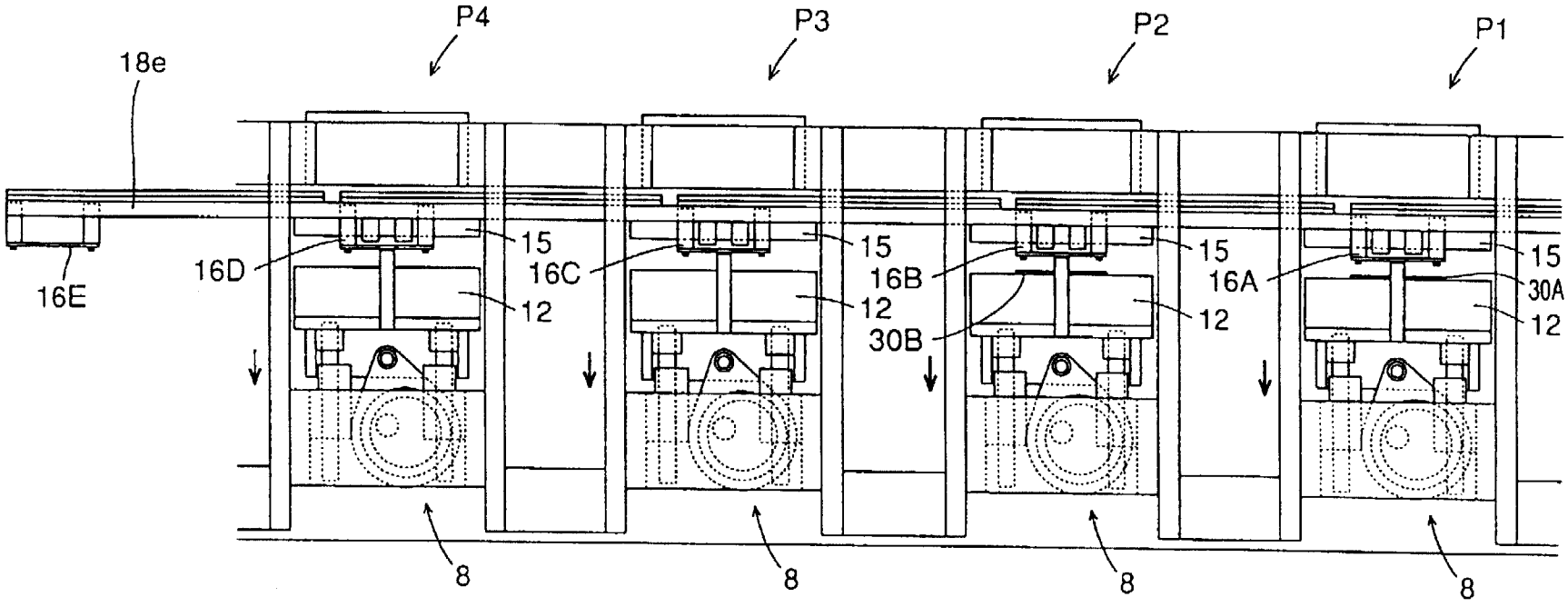
Figure 21:
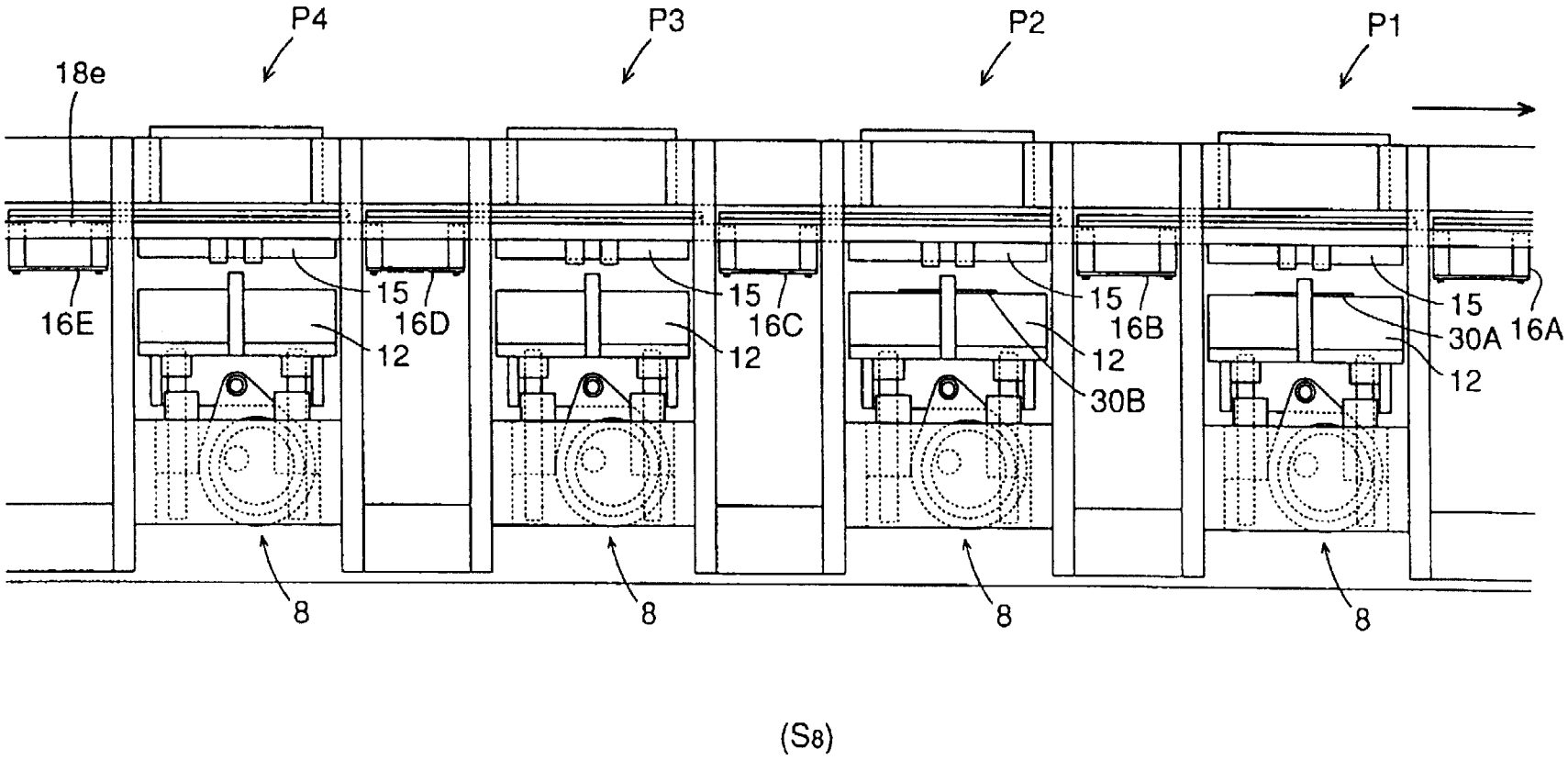

Referring to FIG. 20, the press working machines $P_1$ to $P_4$ are brought into "initial states" from the "workpiece holding/safety confirmation states". This state corresponds to a state $S_8$ shown in FIG. 7. Thereafter the feed bars 16A to 16E are rightwardly moved and retracted as shown in FIG. 21.

Figure 22:
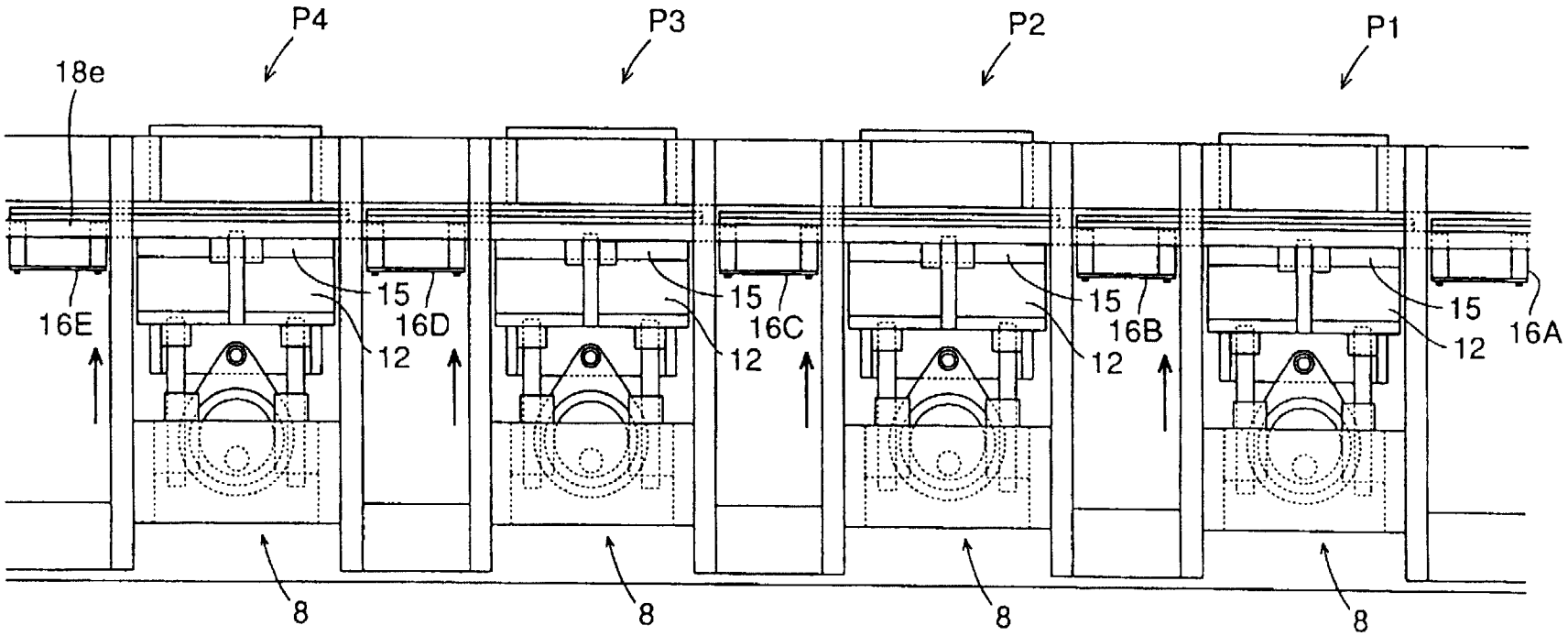
Figure 33:
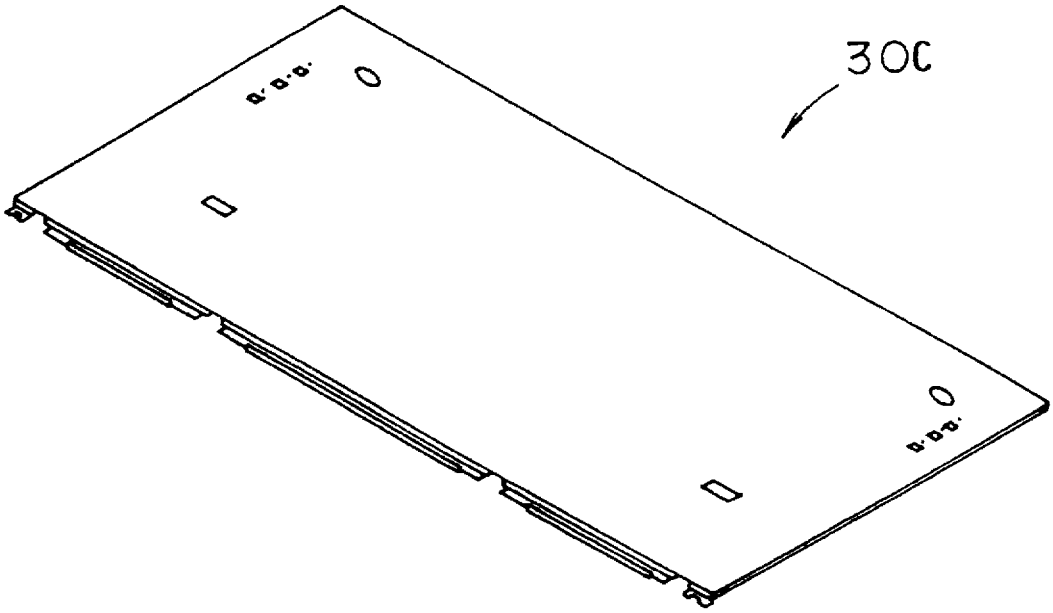
FIG. 33 illustrates the outer shape of a workpiece which is worked with a press working machine $P_3$.
Figure 34:
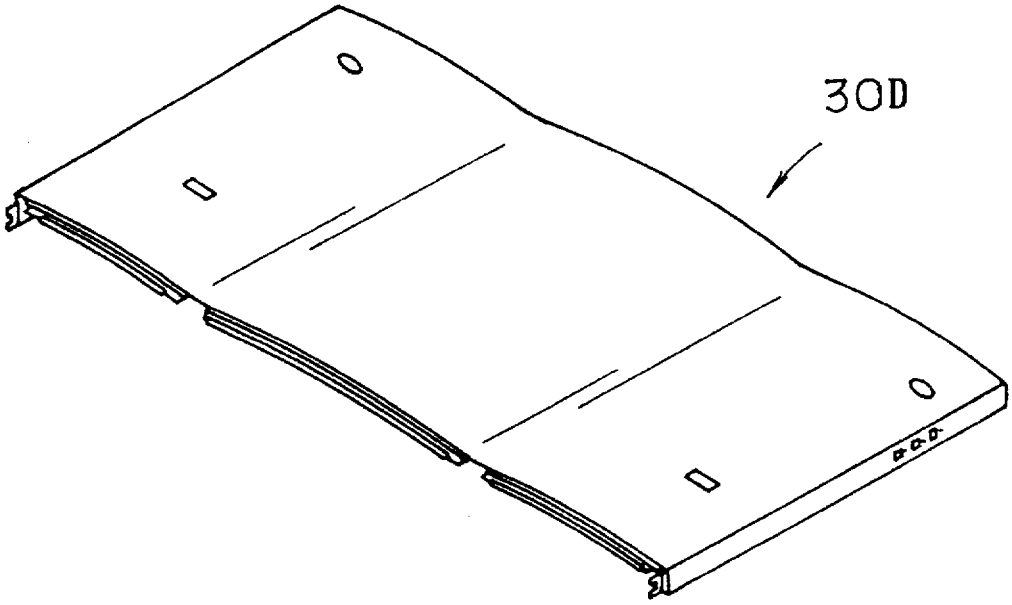
FIG. 34 illustrates the outer shape of a workpiece which is worked with a press working machine $P_4$.

Referring to FIG. 22, the press working machines $P_1$ to $P_4$ are brought into "pressing states" from the "initial states". Thus, the workpieces 30A and 30B are pressworked by the press working machines $P_1$ and $P_2$, to be worked into the workpiece 30B shown in FIG. 32 and a workpiece 30C shown in FIG. 33 respectively.

Figure 23:
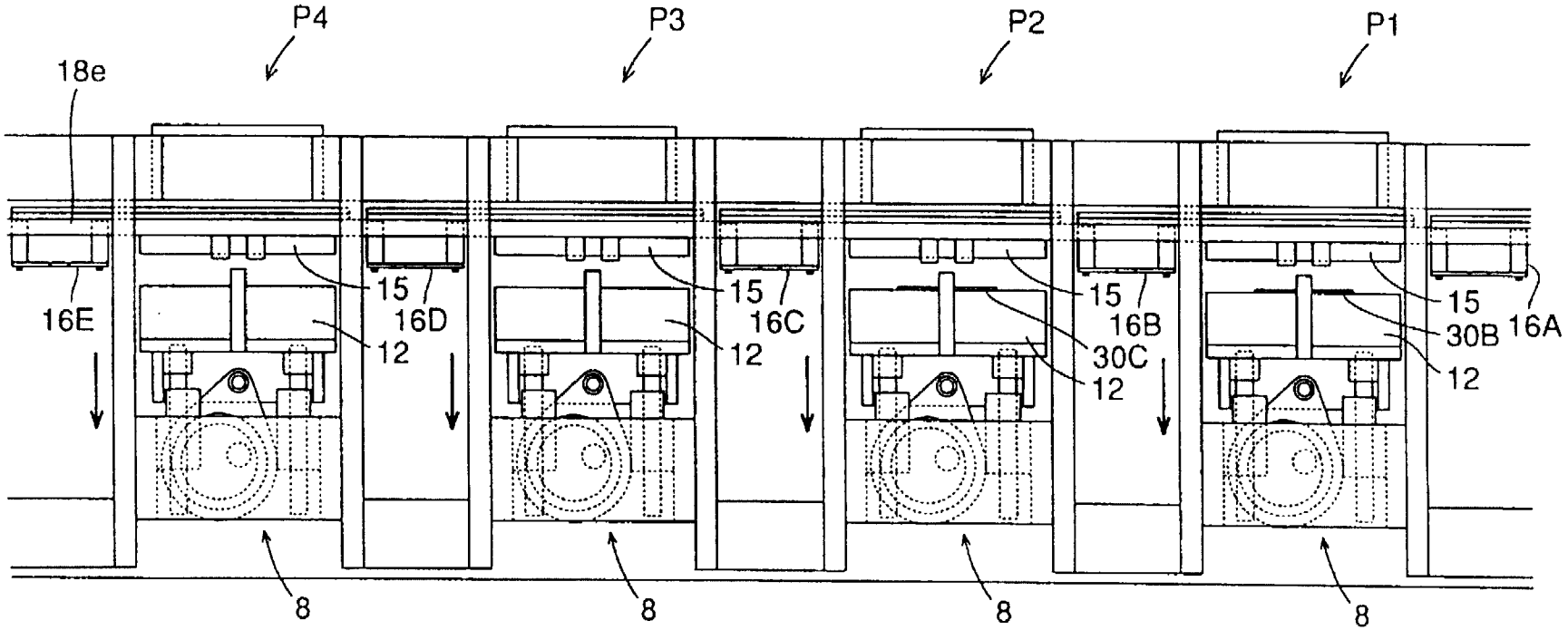
Figure 24:
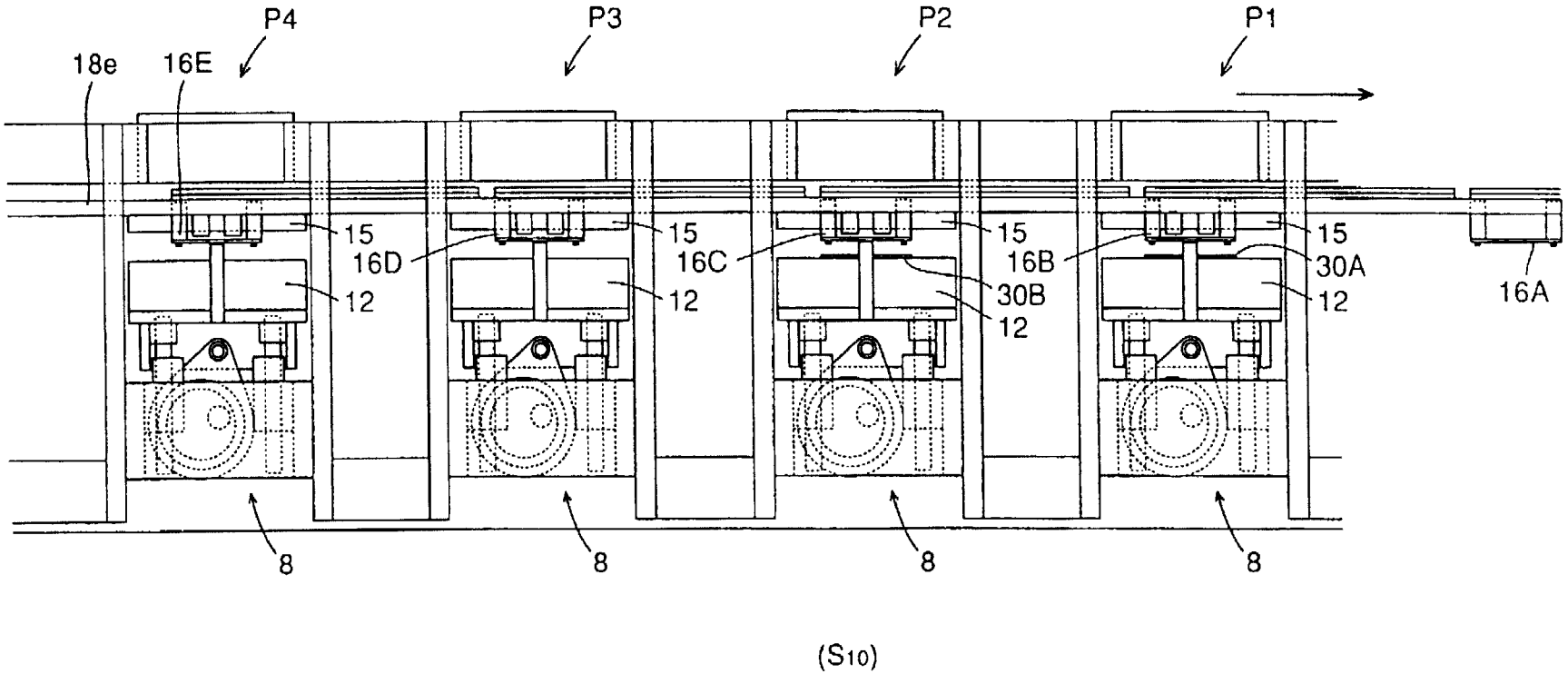

Referring to FIG. 23, the press working machines $P_1$ to $P_4$ are brought into "initial states" from the "pressing states". This state corresponds to a state $S_{10}$ shown in FIG. 7. The steps shown in FIGS. 22 and 23 are not stopped in the "pressing states", but carried out as a series of operations. Thereafter the feed bars 16A to 16E are rightwardly moved as shown in FIG. 24.

Figure 25:
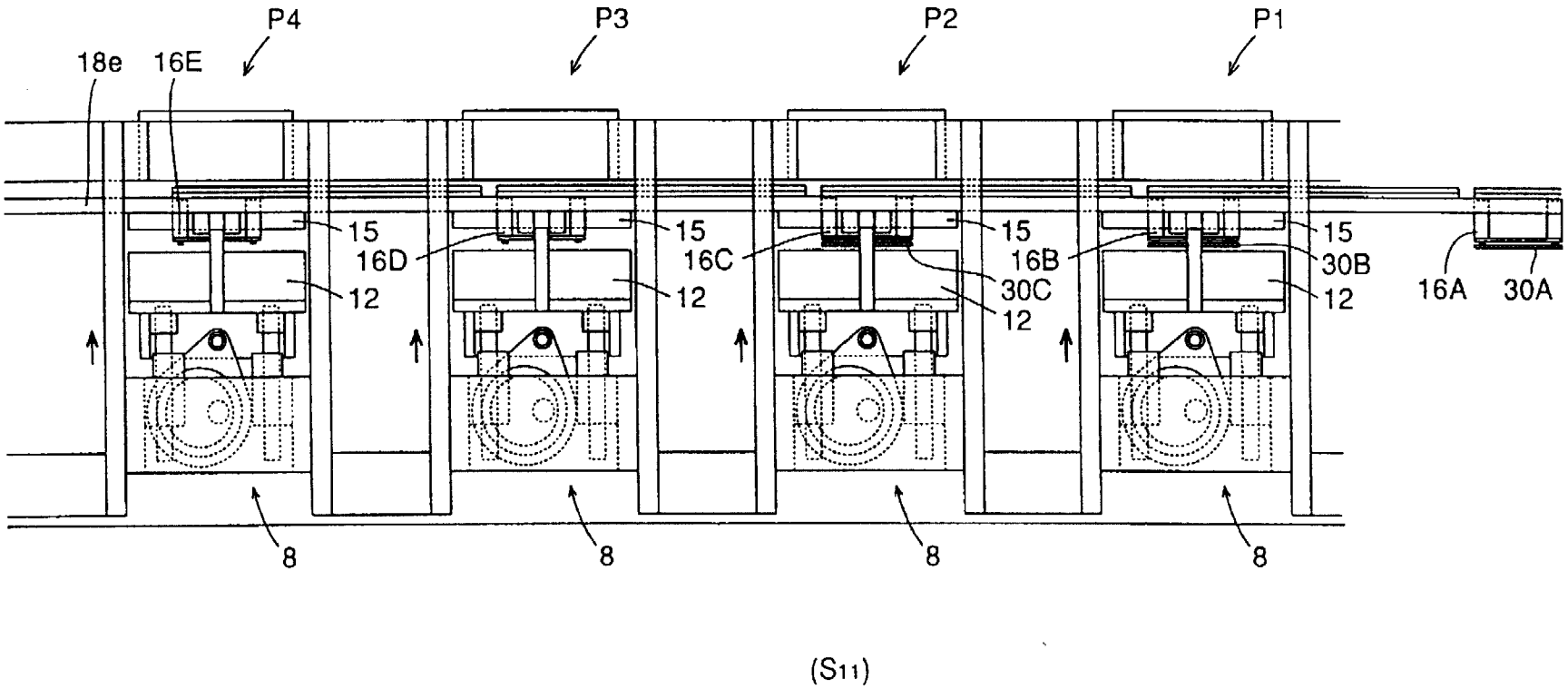

Referring to FIG. 25, the press working machines $P_1$ to $P_4$ are brought into "workpiece holding/safety confirmation states" from the "initial states". Thereafter the feed bar 16A holds a new workpiece 30A, while the feed bars 16B and 16C hold the workpieces 30B and 30C respectively. This state corresponds to a state $S_{11}$ shown in FIG. 7.

Figure 26:
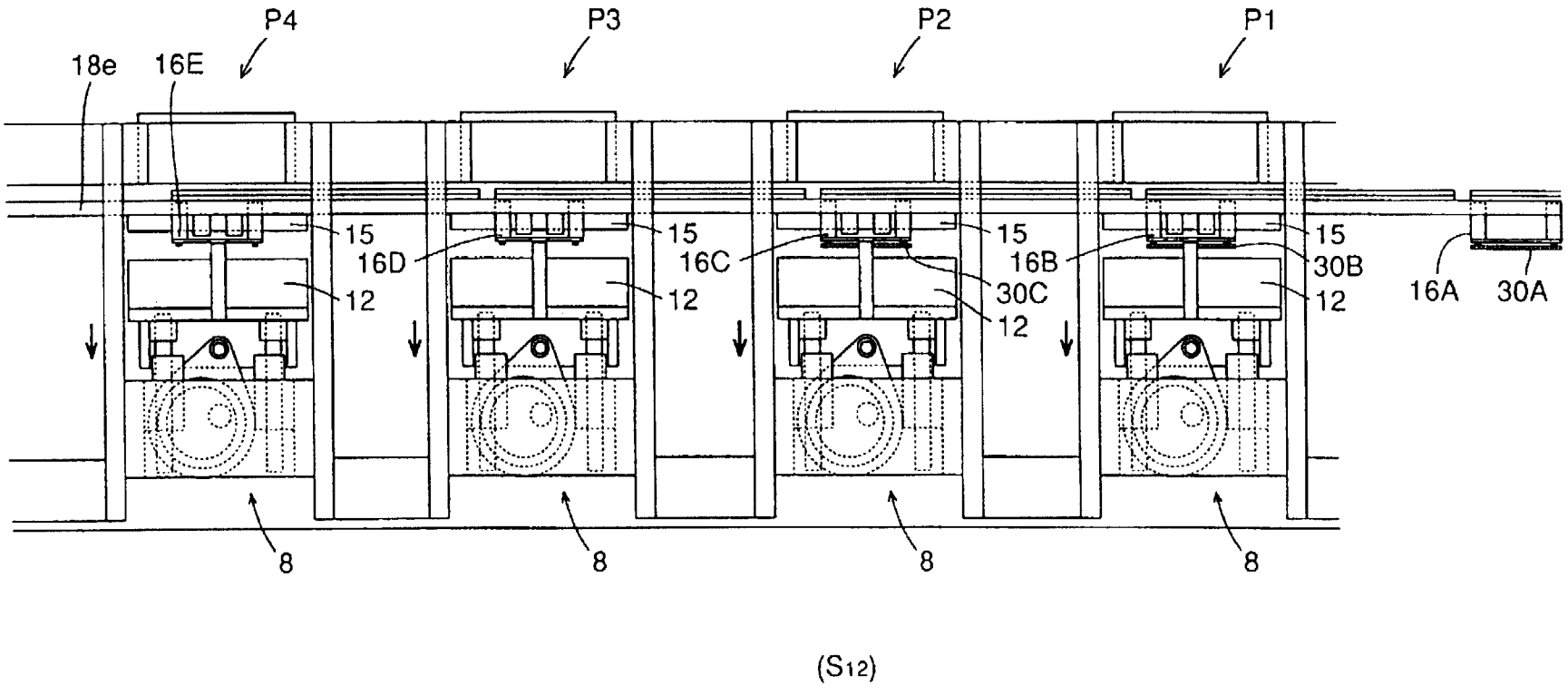
Figure 27:
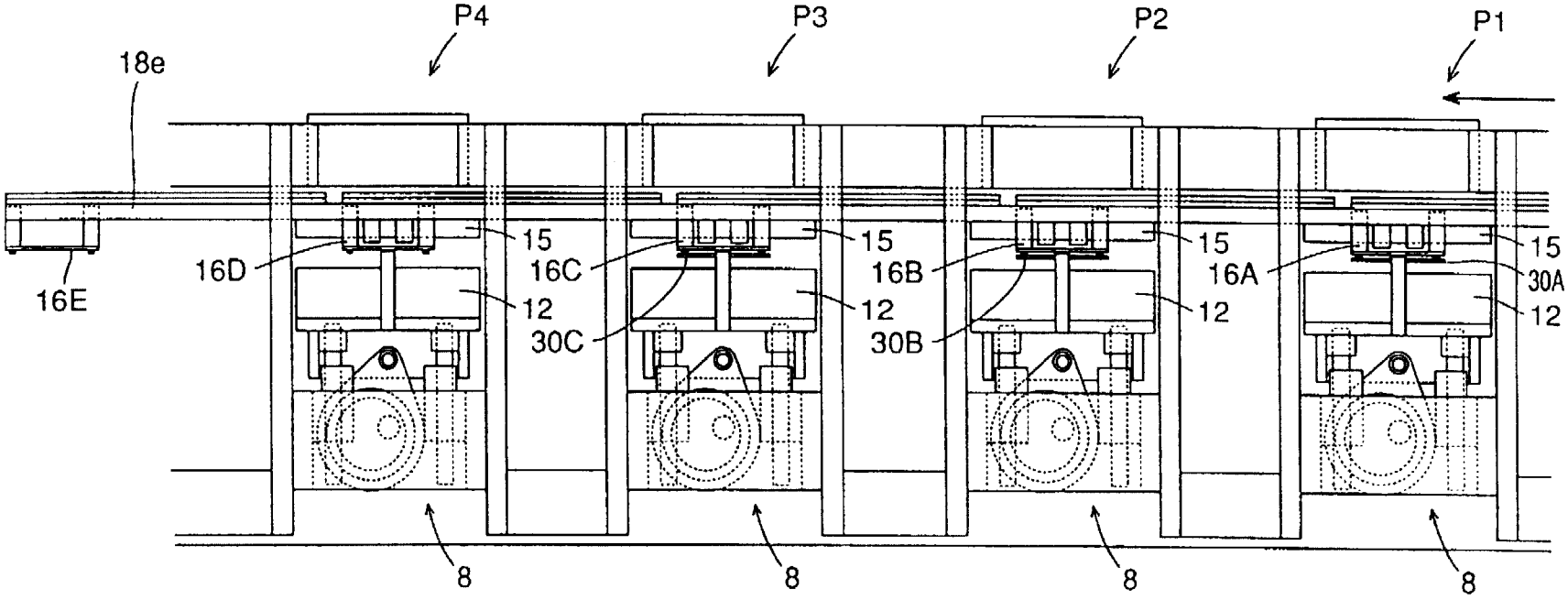

Referring to FIG. 26, the press working machines $P_1$ to $P_4$ are brought into "initial states" from the "workpiece holding/safety confirmation states". This state corresponds to a state $S_{12}$ shown in FIG. 7. Thereafter the feed bars 16A to 16E are leftwardly moved as shown in FIG. 27.

Figure 28:
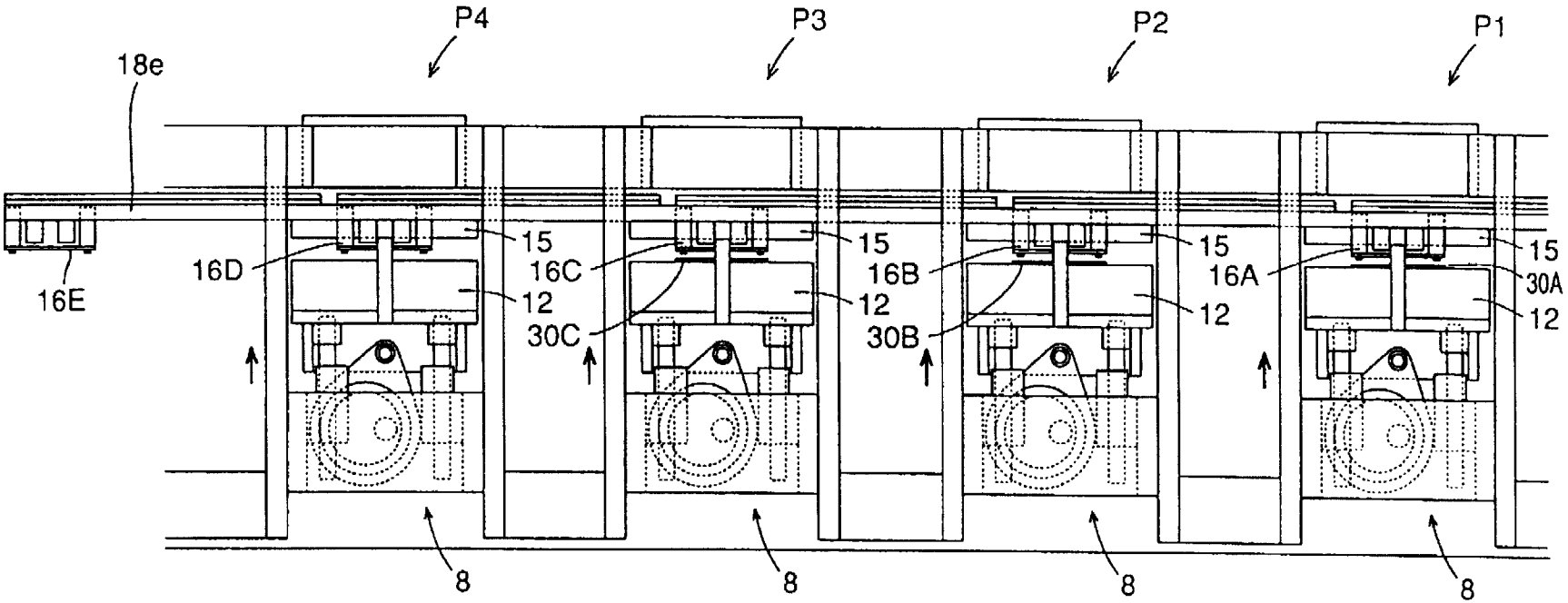

Referring to FIG. 28, the press working machines $P_1$ to $P_4$ are brought into "workpiece holding/safety confirmation states" from the "initial states", so that the workpieces 30A, 30B and 30C are placed on the lower molds 12 of the press working machines $P_1$, $P_2$ and $P_3$ respectively. At this time, the safety pins 19 of these press working machines $P_1$ to $P_3$ confirm positions of the workpieces 30A, 30B and 30C. This state corresponds to a state $S_{13}$ shown in FIG. 7.

Figure 29:
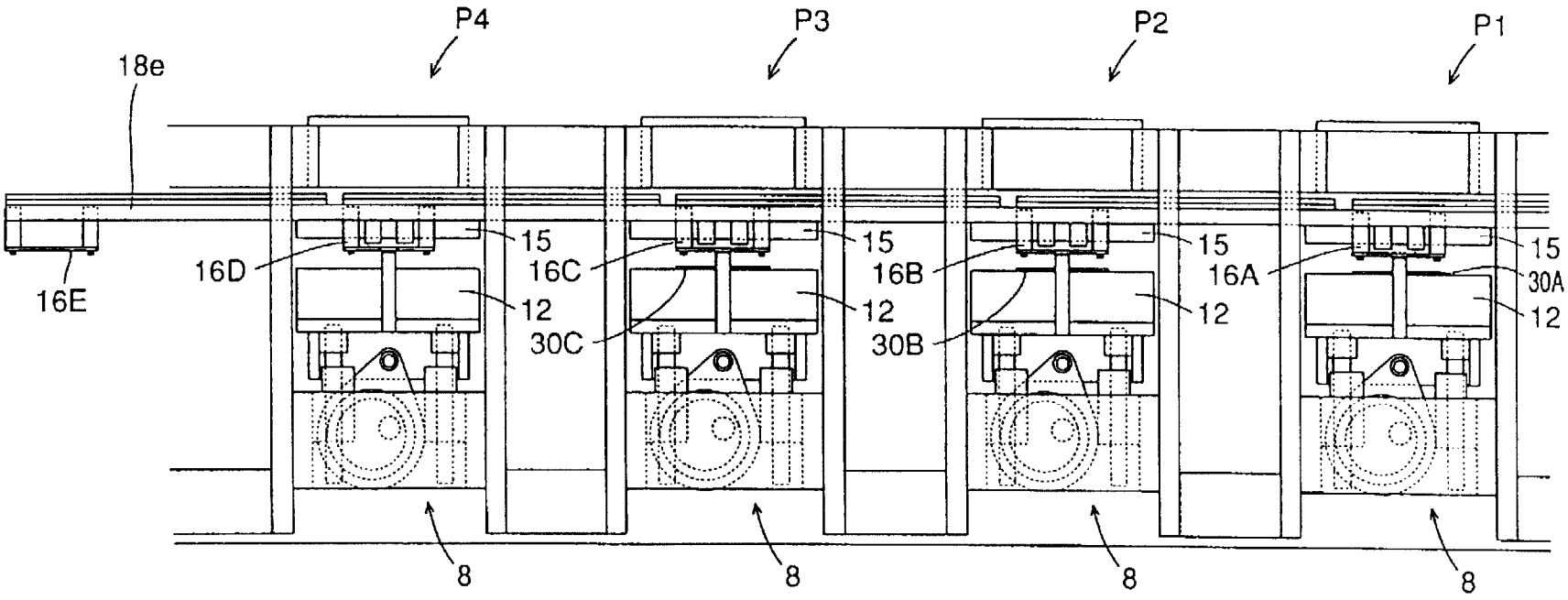
Figure 30:
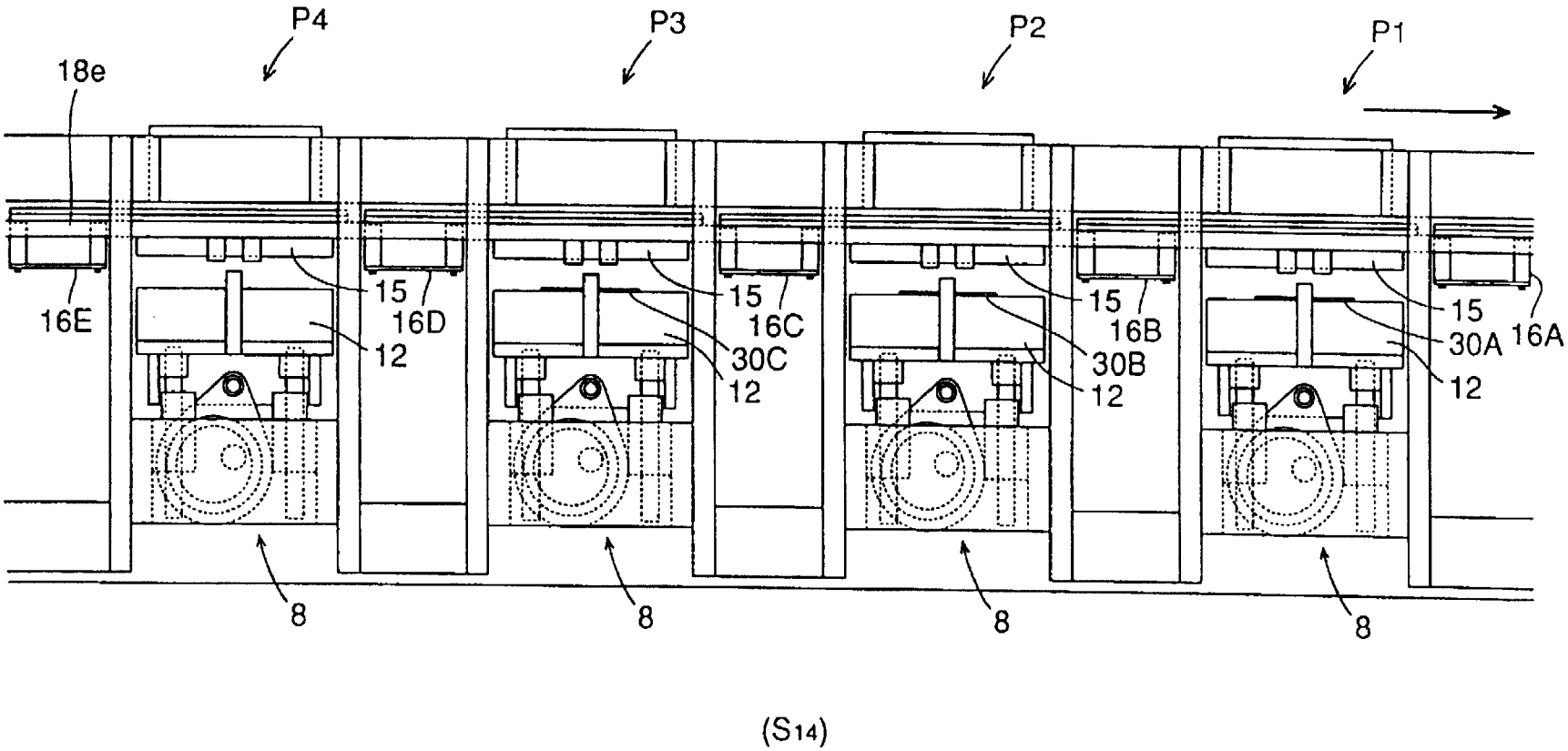

Referring to FIG. 29, the press working machines $P_1$ to $P_4$ are brought into "initial states" from the "workpiece holding/safety confirmation states". This state corresponds to a state $S_{14}$ shown in FIG. 7. Thereafter the feed bars 16A to 16E are rightwardly moved and retracted as shown in FIG. 30.

Thereafter a step which is similar to that shown in FIG. 13 is carried out, so that the workpieces 30A to 30C are press-worked in the press working machines $P_1$ to $P_3$ respectively. Thereafter steps which are similar to those shown in FIGS. 14 to 29 are carried out, so that the respective workpieces 30A to 30D are successively press-worked by the press working machines $P_1$ to $P_4$ into workpiece states shown in FIGS. 31 to 34 respectively.

According to the present invention, as hereinabove described, an under drive press working machine is so constructed that the lower mold 12 is vertically moved through the servo motor and the eccentric cams 8. Thus, the feed bar 16 is only horizontally moved, whereby the structure of the feed bar horizontal mover 18 therefor can be extremely simplified. Further, registration of the workpiece 30 on the lower mold 12 can be confirmed using an extremely simple structure by providing the feed bar 16 and the upper mold 15 with the safety plate 21 and the backup block 20 having the location holes 21*a* and 20*a* for receiving the safety pin 19 which is provided on the lower mold base 11 respectively.

According to the inventive press working machine, the lower mold is vertically moved between the first position for exchanging the lower mold, the second position for exchanging the workpiece, the third position for placing and displacing the workpiece on and from the lower mold, and the fourth position for pressing the workpiece with the upper and lower molds, through the servo motor and the eccentric cams.

Thus, the workpiece carrier is only horizontally moved between the first state for placing and displacing the workpiece on and from the lower mold, and the second state non-interfering with the upper and lower molds for pressing the workpiece. Thus the workpiece carrier is not required to carry out a vertical movement, dissimilarly to the prior art, whereby its structure can be extremely simplified.

The lower mold is vertically moved as hereinabove described, whereby registration of the workpiece and a safety state can be confirmed through an extremely simple structure by providing the safety plate and the backup plate having the holes for receiving the safety pin on the workpiece carrier and the upper mold respectively.

Consequently, the press working machine is extremely simplified in structure, and improved in safety and reliability.

Although the present invention has been described and illustrated in detail, it is clearly understood that the same is byway of illustration and example only and is not to be taken byway of limitation, the spirit and scope of the present invention being limited only by the terms of the appended claims.

What is claimed is:

1. A press working machine for plastically deforming a workpiece consisting of a deformable material by pressing said workpiece between an upper mold and a lower mold thereby forming said workpiece into a prescribed shape, said press working machine comprising a press working machine unit that comprises:

an upper frame adapted to receive the upper mold;

a lower mold base adapted to receive the lower mold thereon;

an eccentric cam arrangement including a pivot portion pivotally supporting said lower mold base, and a driving shaft portion serving as a rotation center of said cam arrangement and driving said cam arrangement;

a servo motor connected with said driving shaft portion for rotationally driving said eccentric cam arrangement to selectively move said lower mold base among a first position for mounting the lower mold on said lower mold base, a second position for exchanging the workpiece, a third position for placing the workpiece on and removing the workpiece from the lower mold, and a fourth position for pressing the workpiece between the upper mold and the lower mold;

a workpiece carrier that is movable in a horizontal direction between a first state adapted for placing the workpiece on and removing the workpiece from the lower mold and a second state in which said work piece carrier does not interfere with the upper mold and the lower mold when said lower mold base is in said fourth position;

a safety pin arranged at a prescribed position on said lower mold base and extending upwardly therefrom;

a safety plate provided on said workpiece carrier, having a first hole capable of receiving said safety pin when said workpiece carrier is in said first state and said lower mold base is at said third position; and a backup block provided on the upper mold, having a second hole capable of further receiving said safety pin when said safety pin is received in said first hole in said safety plate.

2. The press working machine in accordance with claim 1, wherein said cam arrangement further comprises a cam plate;

said pivot portion of said eccentric cam arrangement comprises:

a support shaft pivotally supporting said lower mold base, and a first ball bearing arranged on said cam plate and rotatably receiving said support shaft; and said driving shaft portion of said eccentric cam arrangement comprises:

a rotary shaft connected with said servo motor, a turntable connected with said rotary shaft to rotate therewith, and a second ball bearing arranged on said cam plate and receiving said turntable.

3. The press working machine in accordance with claim 2, comprising two of said eccentric cam arrangement provided at a prescribed distance apart from one another along said rotary shaft, and arranged such that said lower mold base is supported by said two eccentric cam arrangements.

4. The press working machine in accordance with claim 2, wherein said rotary shaft is connected directly with said servo motor.

5. The press working machine in accordance with claim 2, wherein said turntable is a circular disk mounted eccentrically on said rotary shaft to rotate therewith, said cam plate has a circular opening therein with said second ball bearing mounted in said circular opening, and said turntable is received in said second ball bearing such that rotation of said turntable causes said cam plate to move in a vertical stroking motion and to pivot about said support shaft.

6. The press working machine in accordance with claim 1, comprising a plurality of said press working machine units arranged along said horizontal direction of movability of said workpiece carrier, wherein said workpiece carrier is arranged above said press working machine units for successively carrying the workpiece to and among said plurality of press working machine units.

7. The press working machine in accordance with claim 1, wherein said lower mold base is movable in a vertical direction, and said respective positions of said lower mold base are arranged vertically above one another.

8. The press working machine in accordance with claim 7, wherein said first position is a lowermost position, said second position is higher than said first position, said third position is higher than said second position, and said fourth position is higher than said third position.

9. The press working machine in accordance with claim 1, wherein said workpiece carrier is not movable in a vertical direction.

* * * * *